US010314398B2

(12) United States Patent
Bowman et al.

(10) Patent No.: US 10,314,398 B2
(45) Date of Patent: Jun. 11, 2019

(54) PULL-OUT GUIDE FOR THE GUIDANCE OF A DRAWER

(71) Applicant: GRASS AMERICA, INC., Kernersville, NC (US)

(72) Inventors: Christopher Blane Bowman, Mount Airy, NC (US); Cheng Jiang, Kernersville, NC (US); Manfred Peer, Walkertown, NC (US); Georg Domenig, Kernersville, NC (US)

(73) Assignee: Grass America, Inc., Kernersville, NC (US)

( * ) Notice: Subject to any disclaimer, the term of this patent is extended or adjusted under 35 U.S.C. 154(b) by 85 days.

(21) Appl. No.: 15/379,877

(22) Filed: Dec. 15, 2016

(65) Prior Publication Data

US 2017/0172300 A1 Jun. 22, 2017

Related U.S. Application Data

(63) Continuation of application No. 15/244,449, filed on Aug. 23, 2016.

(60) Provisional application No. 62/268,653, filed on Dec. 17, 2015.

(51) Int. Cl.

| | |
|---|---|
| ***A47B 88/487*** | (2017.01) |
| *A47B 88/477* | (2017.01) |
| *A47B 88/43* | (2017.01) |

(52) U.S. Cl.

CPC ..... *A47B 88/487* (2017.01); *A47B 88/43* (2017.01); *A47B 88/477* (2017.01); *A47B 2210/004* (2013.01); *A47B 2210/0059* (2013.01)

(58) Field of Classification Search

CPC ..... A47B 88/487; A47B 88/43; A47B 88/477; A47B 2210/004; A47B 2210/0059

See application file for complete search history.

(56) References Cited

U.S. PATENT DOCUMENTS

| | | | | | |
|---|---|---|---|---|---|
| 4,199,200 | A * | 4/1980 | Livingston | A47B 88/407 | 312/334.18 |
| 4,441,773 | A * | 4/1984 | Leiper | A47B 88/487 | 312/330.1 |
| 4,465,324 | A * | 8/1984 | Rock | A47B 88/487 | 312/334.39 |
| 4,653,821 | A * | 3/1987 | Faust | A47B 88/487 | 248/222.13 |
| 4,778,230 | A * | 10/1988 | Lautenschlager | A47B 88/427 | 312/334.5 |
| 5,213,403 | A * | 5/1993 | Lautenschlager | A47B 88/427 | 312/140 |
| 5,242,221 | A * | 9/1993 | Rotthowe | A47B 88/487 | 312/334.38 |

(Continued)

*Primary Examiner* — Hanh V Tran

(74) *Attorney, Agent, or Firm* — Burr & Brown, PLLC

(57) ABSTRACT

A pull-out guide for the guidance of a drawer, including a cabinet rail for attachment to a furniture cabinet, a drawer rail for attachment to a drawer, and a roller unit having rollers that roll on guide surfaces of the respective rails during movement of the rails relative to one another. The cabinet rail has a vertically extending low-profile side element that does not extend upwardly above a support surface of the drawer rail over at least 75% of its total length. A vertically upwardly protruding flag-like element extends upwardly in the vertical direction to guide a drawer during assembly to the drawer rail.

34 Claims, 18 Drawing Sheets

(56) References Cited

U.S. PATENT DOCUMENTS 5,275,483 A * 1/1994 Rasmussen ..... A47B 88/487 312/334.27
5,306,080 A * 4/1994 Lautenschlager ..... A47B 88/43 312/334.5
5,344,227 A * 9/1994 Rock ..... A47B 88/467 312/334.33
5,417,489 A * 5/1995 Compagnucci ..... A47B 88/493 312/334.11
5,549,376 A * 8/1996 Domenig ..... A47B 88/43 312/334.5
5,570,941 A * 11/1996 Rock ..... A47B 88/43 312/330.1
5,601,350 A * 2/1997 Rock ..... A47B 88/43 312/334.1
5,779,333 A * 7/1998 Lautenschlager ..... A47B 88/43 312/334.14
6,854,817 B1 * 2/2005 Simon ..... A47B 88/493 312/334.6
7,014,282 B2 * 3/2006 Hammerle ..... A47B 88/407 312/330.1
8,424,984 B2 * 4/2013 Ritter ..... A47B 88/427 292/DIG. 56
2002/0101143 A1 * 8/2002 Crooks ..... A47B 88/43 312/334.5
2002/0180321 A1 * 12/2002 Chen ..... A47B 88/43 312/334.4
2003/0132688 A1 * 7/2003 Domenig ..... A47B 88/467 312/334.27
2003/0205955 A1 * 11/2003 Egger ..... A47B 88/43 312/334.5
2004/0000851 A1 * 1/2004 Lam Harn ..... A47B 88/493 312/334.7
2004/0080246 A1 * 4/2004 Michaels ..... A47B 88/487 312/334.5
2005/0225219 A1 * 10/2005 Chen ..... A47B 88/43 312/334.5
2005/0231083 A1 * 10/2005 Garcie, Jr. ..... A47B 88/467 312/333
2006/0273705 A1 * 12/2006 Yeh ..... A47B 88/493 312/334.31
2007/0222346 A1 * 9/2007 Kleinsasser ..... A47B 88/467 312/205
2010/0045153 A1 * 2/2010 Ritter ..... A47B 88/493 312/334.1
2011/0234072 A1 * 9/2011 Hightower ..... A47B 88/43 312/334.5
2012/0080988 A1 * 4/2012 Greussing ..... A47B 88/427 312/334.6
2012/0145845 A1 * 6/2012 Hightower ..... A47B 88/423 248/201
2012/0153795 A1 * 6/2012 Tosin ..... A47B 67/04 312/334.21
2012/0248956 A1 * 10/2012 Netzer ..... A47B 88/493 312/334.9
2013/0076221 A1 * 3/2013 Hammerle ..... A47B 88/14 312/334.1
2013/0127320 A1 * 5/2013 Greussing ..... A47B 88/04 312/334.44
2013/0278125 A1 * 10/2013 Lang ..... A47B 88/04 312/334.1
2014/0070064 A1 * 3/2014 Chen ..... A47B 88/044 248/221.11
2014/0241651 A1 * 8/2014 Greussing ..... A47B 88/487 384/19
2014/0346941 A1 * 11/2014 Gasser ..... A47B 88/04 312/334.1
2015/0296982 A1 * 10/2015 Chen ..... A47B 88/044 312/334.8
2016/0081473 A1 * 3/2016 Jiang ..... A47B 88/0466 312/334.33
2018/0242736 A1 * 8/2018 Duggins ..... A47B 88/43

* cited by examiner

PULL-OUT GUIDE FOR THE GUIDANCE OF A DRAWER

CROSS REFERENCE TO RELATED APPLICATIONS

This application claims the benefit of U.S. Application Ser. No. 62/268,653 filed Dec. 17, 2015, and is a continuation application of U.S. application Ser. No. 15/244,449, filed Aug. 23, 2016, the entireties of which are incorporated herein by reference.

FIELD OF THE INVENTION

The present invention relates to a pull-out guide for the guidance of a drawer, and to a drawer or a furniture item having such a pull-out guide.

BACKGROUND OF THE INVENTION

Pull-out guides for the guidance of a drawer have already become known in various embodiments, in the form of a full extension pull-out guide that includes a cabinet rail, a middle rail and a drawer rail, as well as in the form of a partial or single extension pull-out guide that includes only a cabinet rail and a drawer rail. One application relates to, for example, under-drawer guides, in which the pull-out guides are placed beneath a drawer bottom of a drawer made, for instance, of wood. It is difficult to install partial extension pull-out guides, which include only a cabinet rail and a drawer rail, on a piece of furniture when the front end of the cabinet rail is fixed inside the face frame of the furniture and the rear of the cabinet rail is fixed to the inside rear wall of the furniture cabinent, because it is difficult to ensure that the two runners are installed precisely parallel to one another. If the two runners are not parallel, the drawer will not open and close smoothly. In addition, misalignment of the drawer sometimes occurs when attempting to fasten the drawer rail to the bottom of the drawer, because the bottom of the drawer blocks the view of the installer.

SUMMARY OF THE INVENTION

An object of the present invention is to provide an improved pull-out guide, in particular, with a view to a fitting of the pull-out guide on the furniture item and/or of the drawer on the pull-out guide.

The present invention is based on a pull-out guide for the guidance of a drawer, comprising a cabinet rail for attachment to a furniture cabinet and a drawer rail for attachment to a drawer, wherein a roller unit, the rollers of which roll on a guide surface of the respective rail during a relative movement of the rails one to another, is provided. The cabinet rail comprises a low-profile side element, which in the fitting position is vertically oriented, and the drawer rail possesses a support surface for the fitting of a drawer on the pull-out guide.

The pull-out guide can have, in addition to the cabinet rail and the drawer rail, also a middle rail. Correspondingly, the roller unit is configured either between the cabinet rail and the middle rail and/or between the middle rail and the drawer rail.

The pull-out guide comprises, for instance, an automatic retraction mechanism for a damped closure of the drawer, which retraction mechanism is arranged, in particular, on the cabinet rail.

One aspect of the present invention lies in the fact that the low-profile side element of the cabinet rail does not extend above the upper support surface of the drawer rail over at least 75% of the total length of the cabinet rail. A vertically upwardly protruding flag-like element is provided on the low-profile side element of the cabinet rail, and the protruding element extends upwardly in the vertical direction from a region of the cabinet rail that defines a rearward one-third portion of the overall length of the cabinet rail.

In one embodiment, the protruding element extends above the support surface of the drawer rail in instances where the side wall of the drawer rail does not extend below any portion of the drawer rail itself. In instances where the side wall of the drawer extends below the upper support surface of the drawer rail, the protruding element would still extend upwardly from the drawer rail, but to a lesser extent.

Preferably the protruding element and the cabinet rail are formed as one integral piece so that a material and cost saving in the manufacture of the pull-out guide is obtained.

The protruding element is provided to guide the drawer, in the fitting process, to its final fitting position on the drawer rail. Fitting of the drawer on the drawer rail is thereby facilitated.

Viewed in the longitudinal direction of the drawer rail, the protruding element is, for instance, between 1 and 30 mm long, advantageously between 1 and 20 mm or between 1 and 10 mm. The protruding element is, for example, in its vertical extent, for example starting from a top edge of the low-profile side element, between 1 and 20 mm tall, advantageously between 1 and 15 mm or between 1 and 10 mm.

The protruding element has a thickness, for instance, perpendicular to the low-profile side element, between 0.5 and 30 mm, advantageously between 0.5 and 20 mm, 0.5 and 10 mm, 0.5 and 5 mm or 0.5 and 2 mm. In particular, the protruding element and the low-profile side element have the same thickness.

Advantageously, the low-profile side element is oriented substantially perpendicular to, in particular, a plane support element of the cabinet rail, so that, in the fitted state, the low-profile side element protrudes vertically upward and the support element runs horizontally.

Preferably, the support surface of the drawer rail is of plane configuration and is arranged horizontally or parallel to the support element of the cabinet rail. In one embodiment, the sides of the drawer act as the corresponding member.

For example, the drawer comprises a suitably corresponding member to the protruding element, which member is arranged, in particular, on a drawer side, so that the drawer, in a first fitting step, can be mounted onto the drawer rail and, in a further fitting step, guided by the protruding element in the direction of the rear wall of the furniture cabinet, can be slid and/or fitted onto the drawer rail.

Advantageously, the protruding element is arranged in the rear region of the cabinet rail. In particular, the protruding element is arranged on the cabinet rail between the frontal region of the cabinet rail and a fastening element which is provided to fasten the cabinet rail to the rear wall of the furniture cabinet.

In a basic variant of the pull-out guide, the protruding element further comprises a guide member, which is bent outward from the drawer rail, i.e., away from the drawer rail, in such a way that, in the direction of the longitudinal extent of the drawer rail, the guide member has from its bent-away end a diminishing distance to the remaining side element.

Advantageously, the guide member is bent outward in such a way that in the direction of the longitudinal extent of the drawer rail, starting from the frontal end of the drawer rail, the guide member has from its bent-away end a diminishing distance to the remaining side element of the cabinet rail.

Moreover, the guide member is bent away outward on the side element about an axis which is configured substantially perpendicular to the support surface of the drawer rail.

It is preferred that the protruding element and the guide member are configured in one piece.

Furthermore, it is preferred that the guide member comprises a guide surface and the guide surface is configured in such a way, during fitting of the drawer, to lead the drawer into a fitted position on the drawer rail.

The guide member of the protruding element serves to additionally simplify fitting of the drawer and to guide the drawer, during fitting on the drawer rail, in the direction of the final fitting position, in that the drawer, with a drawer rear wall or the drawer side wall, is guided, in particular, along a guide surface of the guide member during fitting of the drawer into the final fitting position and, to this end, slides or glides along the guide surface.

For example, the guide surface is designed substantially parallel to the low-profile side element of the cabinet rail and substantially perpendicular to the support surface of the drawer rail.

Advantageously, the guide member, for instance the guide surface, is of curved configuration, in particular, the guide member, from a view from above onto the pull-out guide, advantageously has a bend, in particular, a radius, perpendicular to the support surface of the drawer rail.

The guide surface can also be of helical design. For instance, the lower region of the bent-away end of the guide member, in the direction of the longitudinal extent of the drawer rail, is configured closer to the frontal end of the drawer rail than the upper region of the bent-away end of the guide member. The guide member thereby has the shape of a wave.

Furthermore, the cabinet rail can comprise on the low-profile side element a recess, wherein the size of the recess corresponds to a size of the protruding element.

The position of the recess and of the protruding element on the side element of the cabinet rail can be arranged such that, in a punching process, two cabinet rails can be punched side by side out of a single piece of sheet metal in a material-saving and cost-saving manner, with comparatively low or no material waste.

Preferably, the size of the recess corresponds to the size of the protruding element and the size of the guide member, in particular, when the protruding element and the guide member are configured in one piece.

It is also of advantage that the cabinet rail comprises on the low-profile side element a first fastening member, wherein the cabinet rail comprises on a support element running at a right angle to the low-profie side element a second fastening member, and wherein the cabinet rail can be fitted by means of the fastening members frontally in a plane of the furniture cabinet.

Advantageously, the fastening members are designed as through holes. The cabinet rail can hence be fixed to the furniture cabinet by means of screws at the through holes.

Preferably, the fastening members are configured on a frontal region of the cabinet rail. The cabinet rail can hereby be fixed, for instance, by the first fastening member to a vertically running support, and by the second fastening member to a running strut, running horizontally thereto, in the frontal region of the furniture cabinet.

Hence a comparatively simple, stable and cost-effective fitting of the pull-out guide in the frontal region on the furniture cabinet is possible.

The cabinet rail can also have on an underside facing away from the drawer rail a fastening point, wherein the fastening point is provided to arrange the cabinet rail on the furniture cabinet, wherein the fastening point comprises a mounting member, and wherein the cabinet rail is positionable by the mounting member on a frontal, horizontally running strut of the furniture cabinet.

Advantageously, the fastening point comprises two mounting members.

As a result, the cabinet rail can be fixed and/or clipped and/or plugged onto and/or oriented comparatively easily, by means of the fastening point, to a frontally horizontally running strut of the furniture cabinet.

For example, the mounting member is punched and/or cut out of the cabinet rail as a bent-out tongue and a bent-over element, or is bent out and/or edged on the cabinet rail.

Moreover it is important that on the rear region of the drawer rail is arranged a reinforcing member for the reinforcement of the drawer rail, which reinforcing member encloses the drawer rail at least at the top and side.

In the fitted state on the drawer rail, the, for instance, clamp-like reinforcing member encloses the drawer rail at least at the top and side in such a way that a weight of a drawer fitted on the drawer rail, in particular, with content, can be substantially increased, compared to a drawer rail without a reinforcing member fitted thereon.

The reinforcing member can be plugged and/or clamped and/or clipped onto the drawer rail.

Advantageously, the reinforcing member is formed of a metal, in particular, steel, or a stable plastic or a combination of materials.

As a result of the reinforcing member, a drawer rail of a pull-out guide, consisting only of a cabinet rail and a drawer rail, is reinforced such that an extension length of the drawer rail can be lengthened to match that of a three-piece pull-out guide.

Moreover, it is of advantage that the reinforcing member can be fitted without tools to, for example, snapped onto, the drawer rail by a latching member. For instance, the latching member is punched and/or bent out of the support surface of the drawer rail.

Advantageously, the drawer rail comprises a latching member, which is configured in the rear end region of the drawer rail on the support surface and which is designed to receive the reinforcing member for the reinforcement of the drawer rail.

As a result of the latching member, the reinforcing member can be fitted on the drawer rail in a comparatively simple, fast and cost-effective manner.

Moreover, it is significant that the roller unit has cylindrical rollers, which on opposite flat end faces comprise toroidally arched bearing surfaces of a bearing element which otherwise protrudes from the rest of the end face. This allows for a simple fitting of the rollers to the roller unit.

In an advantageous variant of the present invention, the roller unit is configured such that it functions as a middle rail. As a result of a lengthened design of the roller unit, it is possible to advantageously lengthen the extension distance of the drawer rail. To this end, in an extreme extension position of the drawer rail, a portion of the roller unit extends over an end of the cabinet rail in the direction of extension.

As a result of the lengthened design of the roller unit, in particular, all rollers of the roller unit support the weight of the drawer over the extension length on the drawer rail.

While the remaining extension length extends over a portion of the roller unit on which rollers are arranged, one end of the cabinet rail, these cannot in this state support a weight of the drawer on the cabinet rail.

In a further embodiment of the present invention, the cabinet rail comprises a braking member for the roller unit. The braking member forms a friction stop, against which a counterpart of the roller unit, in the extended state of the drawer rail, abuts in such a way that the roller unit, when the drawer rail or the drawer fitted to the drawer rail is pulled out on the cabinet rail, remains on the latter. The contacting of the braking member with the roller unit happens, in particular, gradually, preferably without an abrupt abutment, but with increasing braking force.

The braking member can form a pure stop for the counterpart of the roller unit, so that the roller unit, when the drawer rail or the drawer fitted to the drawer rail is pulled out on the cabinet rail, remains on the latter.

The roller unit is, in particular, a cage roller unit.

Advantageously, the roller unit is designed lengthened such that the weight of a drawer fitted onto the drawer rail is distributed amongst at least 10 bearing rollers of the roller unit.

For instance, the roller unit comprises more than 10 rollers, advantageously between 11 and 20 rollers, for instance 11, 12, 13, 14, 16, 17, 18, 19, 20, for example, between 10 and 15 rollers, in particular, 15 rollers, which support the weight of the drawer and/or of the drawer rail. The weight capacity of a drawer can hereby advantageously be increased. The weight capacity of the drawer, in particular, with content, which acts on the rollers is hence also distributed among a plurality of rollers.

If the pull-out guide comprises, in addition to a cabinet rail and a drawer rail, also a middle rail, in which embodiment the roller unit is provided between the middle rail and the drawer rail and/or the cabinet rail and the middle rail, the advantageous design of the roller unit enables a lengthening of the extension length of the drawer and/or an increase in that weight of the drawer which is to be borne by the pull-out guide.

It is also of advantage that the drawer rail comprises a suspension element and the suspension element is punched out and bent out on the drawer rail.

For instance, the suspension element is in a first production step punched or cut or lasered out of the drawer rail, and in a second production step bent and/or pressed into its working shape.

The suspension element is designed such that the drawer is coupled with the drawer rail via the suspension element, or the drawer is fastened to the drawer rail by the suspension element. For instance, the drawer comprises on its rear region an opening, in which, in the fitted state, the suspension element engages.

In particular, the suspension element can prevent the drawer from being lifted off the pull-out guide in the opened state.

In addition, it is proposed that the suspension element has a bead.

Advantageously, the suspension element has for instance, in a middle region, a rib-shaped element, for instance a bead. The rib-shaped element is formed on the suspension element, for example, by a punching process. The rib-shaped element improves the stability of the suspension element.

It also proves advantageous that on the suspension element is arranged a damping element.

The damping element arranged on the suspension element serves, for instance, to damp or to wholly eliminate a noise which arises during the closing operation of the drawer and which can be generated when the rear wall of the drawer bumps against the suspension element.

In another embodiment of the present invention, in which the low-profile side element of the cabinet rail does not extends above the support surface of the drawer rail over at least a dominant longitudinal extent, wherein on the low-profile side element is configured a vertically upwardly protruding flag-like element, wherein the protruding element juts over the support surface of the drawer rail upwardly in the vertical direction, wherein the protruding element comprises a guide member, which is bent outward away from the drawer rail in such a way that, in the direction of the longitudinal extent of the drawer rail, the guide member has from its bent-away end a diminishing distance to the remaining side element, it is preferred that in this modification the protruding element can be plugged onto the low-profile side element.

For instance, the protruding element is configured as a tab, which is clipped and/or plugged and/or clamped onto the low-profile side element.

The protruding element can hence be formed comparatively cost-effectively by plastic injection molding. The protruding element can be formed of metal, plastic or a combination of materials.

BRIEF DESCRIPTION OF THE DRAWINGS

Several illustrative embodiments are explained more closely below, with mention of further advantages and details, on the basis of schematic drawings, wherein.

DETAILED DESCRIPTION OF THE INVENTION

Figure 1:
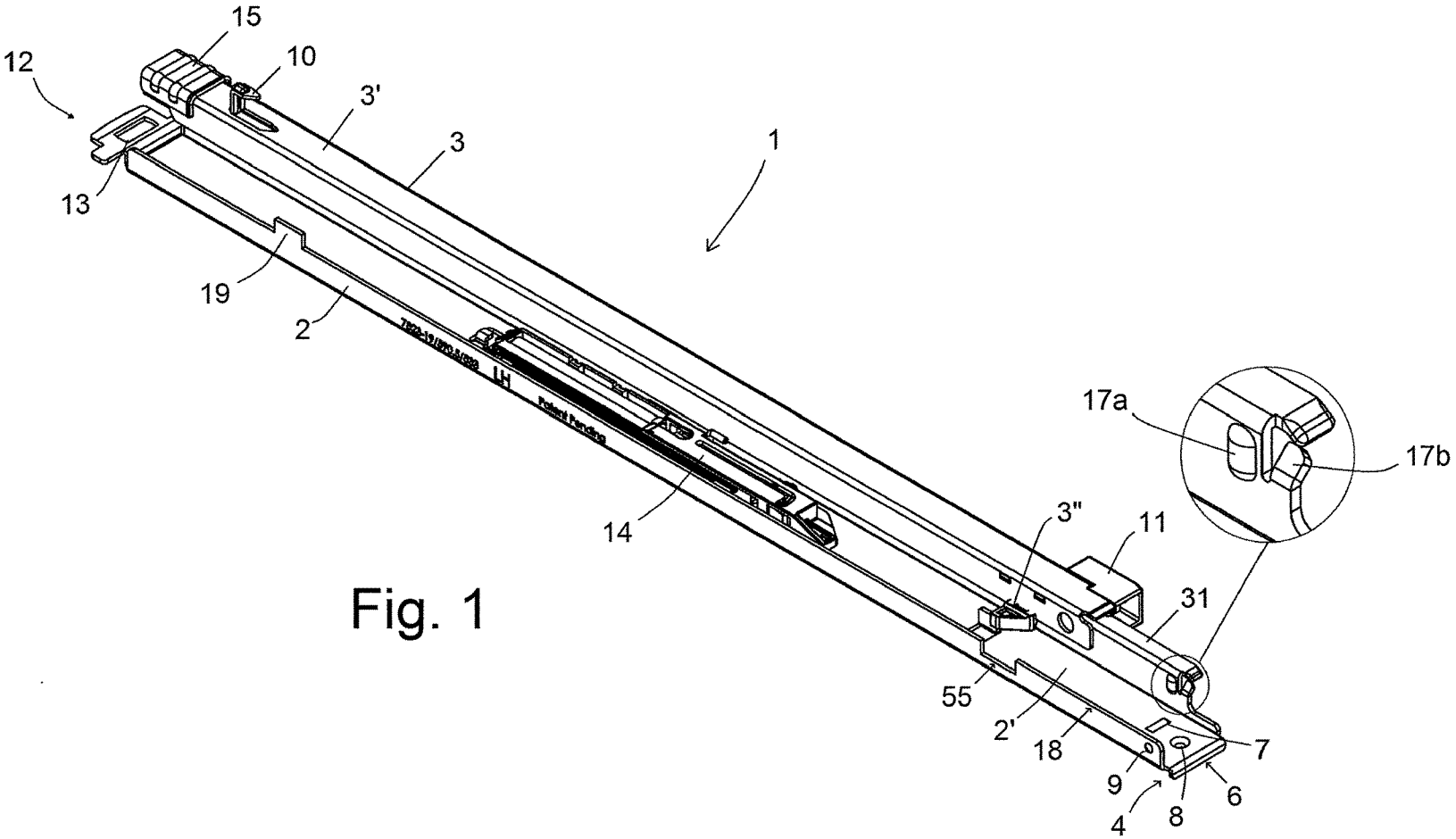
FIG. 1 shows a perspective view from above, from laterally at the front, of a pull-out guide according to the present invention.

In FIG. 1, a single extension pull-out guide 1 comprising a cabinet rail 2 and a drawer rail 3 is represented. At a frontal end 4 of the cabinet rail 2, for attachment to or for contact against a cabinet crossbeam 5 (FIG. 13), is configured a tongue 6, which is bent over downward through 90° at the forward end of support element 2', and a downwardly punched-out and angled-off fastening element 7, in the form of a lip spaced a distance rearwardly from tongue 6 (see also FIG. 17). The spacing distance matches the thickness of crossbeam 5. Moreover, bores 8 and 9 are provided for the insertion of a locating screw.

The drawer rail 3 of the single extension pull-out guide 1 has an upper support surface 3' on which a drawer 52 consisting of at least a drawer bottom 50 and a drawer front 51 (FIG. 17) is secured.

On the cabinet rail 2 is configured at the frontal end 4 a protrusion 17*a* bent out from the material of the cabinet rail 2, which slows down the roller unit 16 (FIG. 9), as described in more detail below with respect to FIGS. 9 and 10. A portion of the cabinet rail 2 forward of protrusion 17*a* is bent out to form a stop member 17*b* and forms a stop for the roller unit 16. As a result of the laterally projecting knob-like configuration of the protrusion 17*a* on a vertically running angled-off side element of the cabinet rail 2, a motion of the roller unit 16 as it passes over the protrusion 17*a* is braked. Moreover, the roller unit 16 cannot pass fully over the protrusion 17*a*, but rather, after a certain crossing distance, butts against stop member 17*b*, so that the roller unit cannot slide off the cabinet rail 2. There is also a stop (not shown) on the rear portion of the drawer rail 3 that engages the rear of the roller unit 16 to prevent the drawer rail 3 from sliding off the roller unit 16.

FIG. 1 also shows a stop member 3" fixed to a side of drawer rail 3, which abuts against a stop surface 2" (FIG. 10) to limit the return distance of the drawer rail 3 when the drawer is closed.

Figure 17:
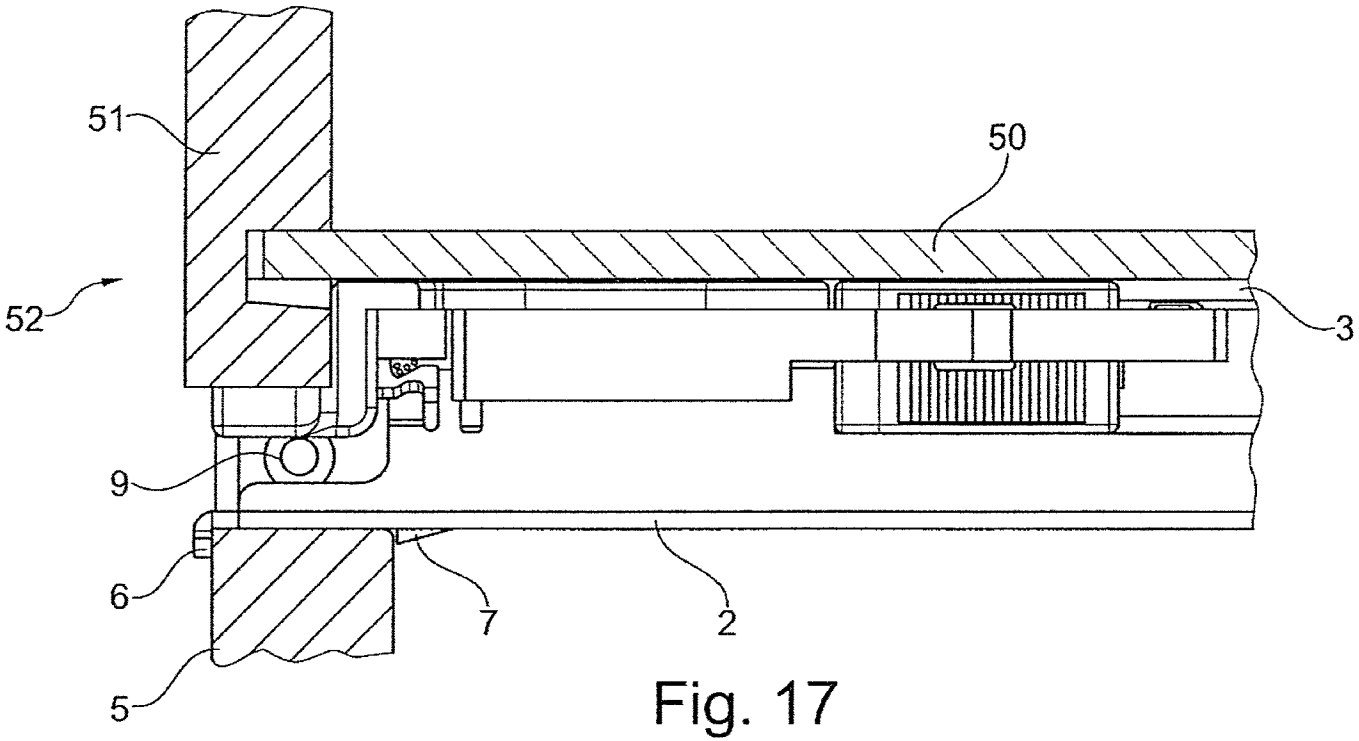
FIG. 17 shows a lateral sectional view, through a furniture cabinet, of a pull-out guide according to FIG. 1 in the fitted state on the furniture cabinet, with a drawer arranged thereon.

Moreover, at the rear end 12 on the drawer rail 3 is configured a suspension element in the form of a hook 10, as well as, at the frontal end 28 of the drawer rail 3, a latching block 11 for latch-locking to a drawer 52 (see, in this regard, FIG. 17). The latch-locking can be realized via a detent coupling which is configured on the drawer 52. Moreover, at the rear end 12 of the cabinet rail 2, a mounting slot 13 for a lateral adjustment of the single extension pull-out guide 1 is present. Over the drawer rail 3 is arranged, at the rear end 12, a reinforcing member in the form of a clamp 15, which encloses the drawer rail 3 at the top and side.

Furthermore, on the cabinet rail 2 is fitted an automatic retraction mechanism 14 to enable a damped retraction of the drawer rail 3 into the fully retracted state on the furniture cabinet 42.

On the low-profile side element 18 of the cabinet rail 2, a flag-like protruding element 19 integrally connected to the cabinet rail 2 is additionally present, protruding in the upward direction. A recess 55, corresponding to the flag-like protruding element 19, is shown in a front region of the side element 18 of the cabinet rail 2.

As shown in FIG. 1, the height of the low-profile side element 18 is very low. As such, when a drawer having a side wall that extends below the upper support surface 3' of the drawer rail 3 is first positioned on the drawer rail 3, it is possible that the side wall of the drawer can move in a direction beyond the low-profile side element 18, in which case the holes in the back of the drawer will not align with the hook 10. The presence of the protruding element 19 acts as a guide for the side wall of the drawer to ensure that the holes in the back of the drawer properly align with the hook 10.

Figure 2A:
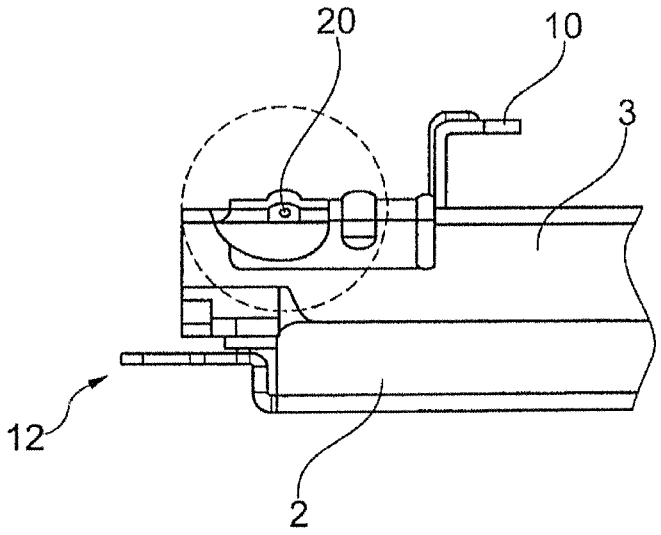
FIGS. 2*a*, 2*b* and 3 show a lateral view of a rear end of the pull-out guide from FIG. 1, with a partial sectional view through a drawer rail, a clamp and a latching member of the pull-out guide.
Figure 2B:
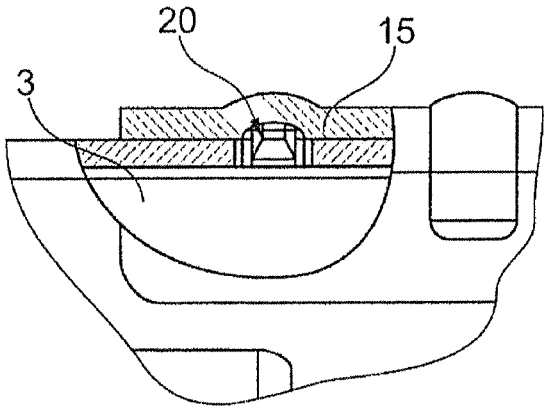
Figure 3:
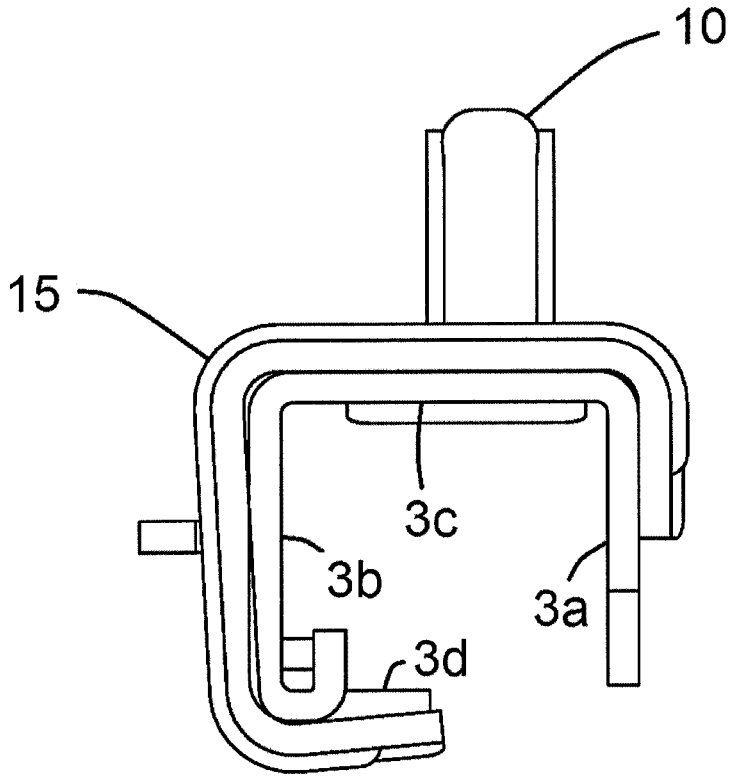

In FIGS. 2*a*, 2*b* and 3, in a section through the drawer rail 3 and the clamp 15, is shown a, for instance, hook-like latching member 20, with which the clamp 15 is latched retentively in the fitted state on the drawer rail 3. The drawer rail 3 comprises the latching member 20, which is punched and/or bent, for example, out of the drawer rail 3.

As shown in FIG. 3, the cross sectional shape of the drawer rail 3 is that of a partial polygon that includes first 3*a* and second 3*b* sides joined together by a top side 3*c*, which opposes a partial bottom side 3*d*. This shape allows the drawer rail 3 to be displaceably positioned around the upper guide surface 31 of the cabinet rail 2. When the drawer rail 3 is in the fully extended position and a substantial weight is placed in the drawer, the rearward end of the drawer rail 3 can actually expand in its lateral dimension and become disconnected from the cabinet rail 2. By positioning the reinforcing clamp 15 on the rear end portion of the cabinet rail 3 as shown in FIG. 3, the lateral expansion and separation problem was resolved, and the weight capacity of the drawer was increased substantially. Preferably, the reinforcing clamp 15 encloses at least part of at least three sides, more preferably four sides, of the drawer rail 3. Preferably, the reinforcing clamp 15 is formed from heat-treated steel.

Figure 4A:
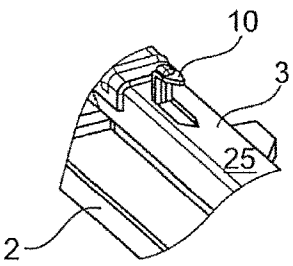
FIGS. 4*a* to 4*c* show a hook of the pull-out guide from FIG. 1 in different views.
Figure 4B:
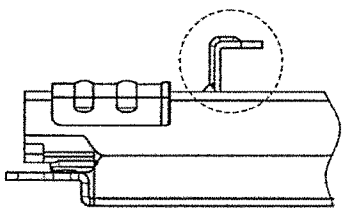
Figure 4C:
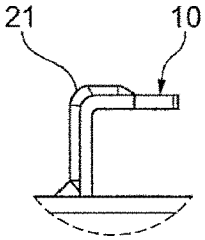

In FIGS. 4*a* to 4*c*, the hook 10, which has been punched out of the drawer rail 3 and is bent over, is shown in different perspective and enlargement. On the hook 10 is configured, on a middle region, a bead 21, which lends stability to the hook 10 reinforce it. The hook 10 fits into corresponding holes in the rear wall of the drawer 52 to trap the drawer 52 by the rear region of the drawer 52 and to fix it or hold it on the drawer rail 3.

Figure 5A:
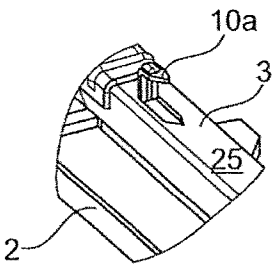
FIGS. 5*a* to 5*c* and 6*a* to 6*c* show further variants of a hook of a pull-out guide according to the present invention in different views.
Figure 5B:
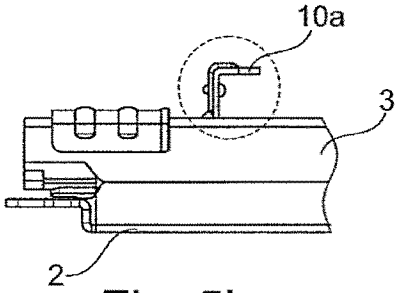
Figure 5C:
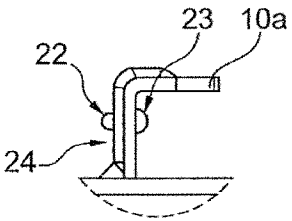

In FIGS. 5*a* to 5*c*, a further variant of a hook 10*a* is shown. On the perpendicularly protruding region 24 of the hook 10*a* can be provided a mounting opening 22, by means of which a damper 23 can be arranged on the hook 10*a*. The damper 23 is provided to damp or to prevent, in a closing operation of the drawer 52 which is fitted on the drawer rail 3, a noise, for instance, a clicking noise, which is caused by a collision of the rear side of the drawer with the hook 10*a*. More specifically, since the pull-out guide will be sold to a variety of furniture manufacturers, and since the holes in the rear wall of the drawer 52 will vary from manufacturer-to-manufacturer, it is necessary to provide the damper 23 to essentially make up the slack between the hook 10*a* and holes in the drawer. It is also common for the overall length of the drawer to vary among manufacturers, so the damper 23 can also make up for this variation to avoid movement of the drawer relative to the drawer rail.

Figure 6A:
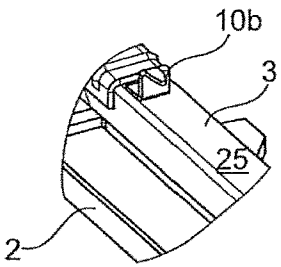
Figure 6B:
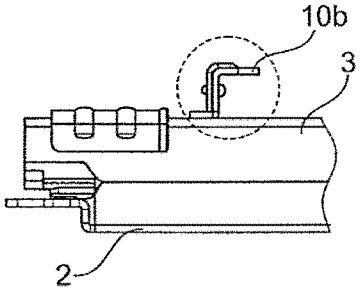
Figure 6C:
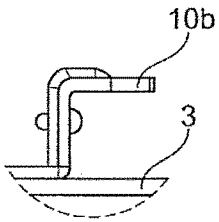

In FIGS. 6*a* to 6*c* is represented a further variant of a hook 10*b*, which is welded, glued, soldered or riveted onto a top side 25 of the drawer rail 3. All variants mentioned in relation to the embodiments of the hooks 10 or 10*a*, for example, a bead or damper, are also applicable to the hook 10*b*.

Figures 7, 8:
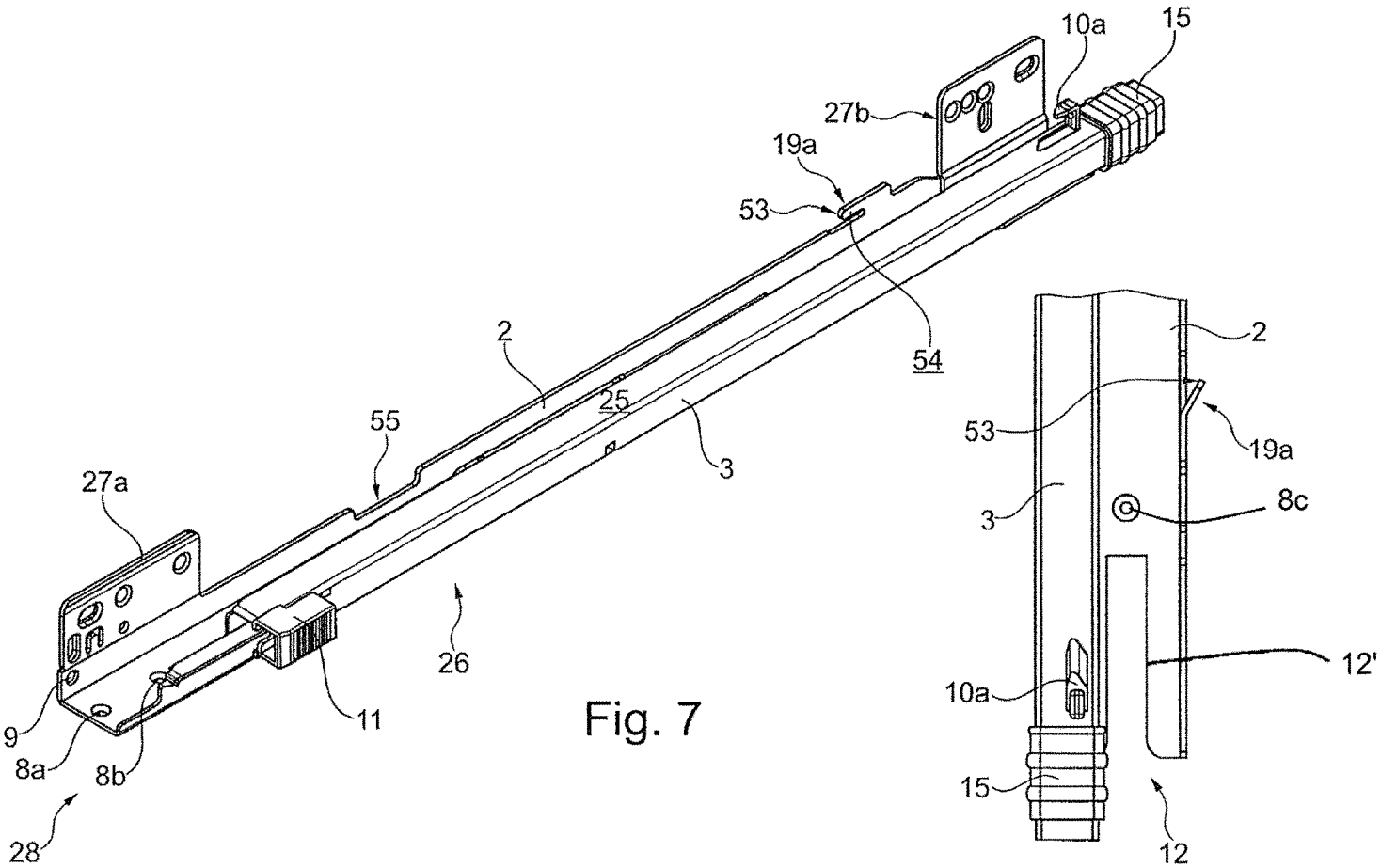
FIG. 7 shows a perspective view of a further pull-out guide according to the present invention with mounting brackets for the lateral fitting.
FIG. 8 shows a top view of the rear end of the pull-out guide from FIG. 7, without mounting brackets.

In FIG. 7 is shown a variant of a single extension pull-out guide 26, which, by means of mounting brackets 27*a* and 27*b*, can be arranged on horizontally running cabinet supports (not shown) and/or on a cabinet side wall. The mounting brackets 27*a*, 27*b* are connected, at least on the bent-over side element 18 of the cabinet rail 2, to the cabinet rail 2. As a result, specifically at the front end 28 of the single extension pull-out guide 26, the cabinet rail 2 can be fastened directly on the cabinet crossbeam 5 (FIG. 17). In the rear region of the cabinet rail 2, it is possible for the cabinet rail 2 to rest on the mounting bracket 27*b*, which has a locking component that slides into the slot 12' formed in the rear end 12 of the cabinet rail 2 (FIG. 8). The cabinet rail 2 includes bores 8*a*, 8*b*, 8*c* and 9 for the insertion of locating screws. Bores 8*a*-8*c* allow the cabinet rail to be fixed directly to the bottom panel of a furniture cabinet, in which case the mounting brackets 27*a*, 27*b* would not be necessary.

The flag-like element 19*a* in this embodiment extends vertically upwardly above the upper support surface 3' of the drawer rail 3, because the pull-out guide depicted in FIG. 7 is designed to work with a drawer that has side walls that do not extend below the upper support surface 3' of drawer rail 3.

The flag-like element 19*a* is configured in such a way on the cabinet rail 2 that it comprises a boss 53, which protrudes forward in the fitted state in the direction of the furniture front, and which, for the easier fitting of a drawer 52, is bent outward away from the drawer rail 3 at an acute angle (FIG. 8). That inner face 54 of the boss 53 which points toward the drawer rail 3 hereby forms a guide for the sidewalls of the drawer 52 during a fitting operation of the drawer 52.

Figures 9, 10:
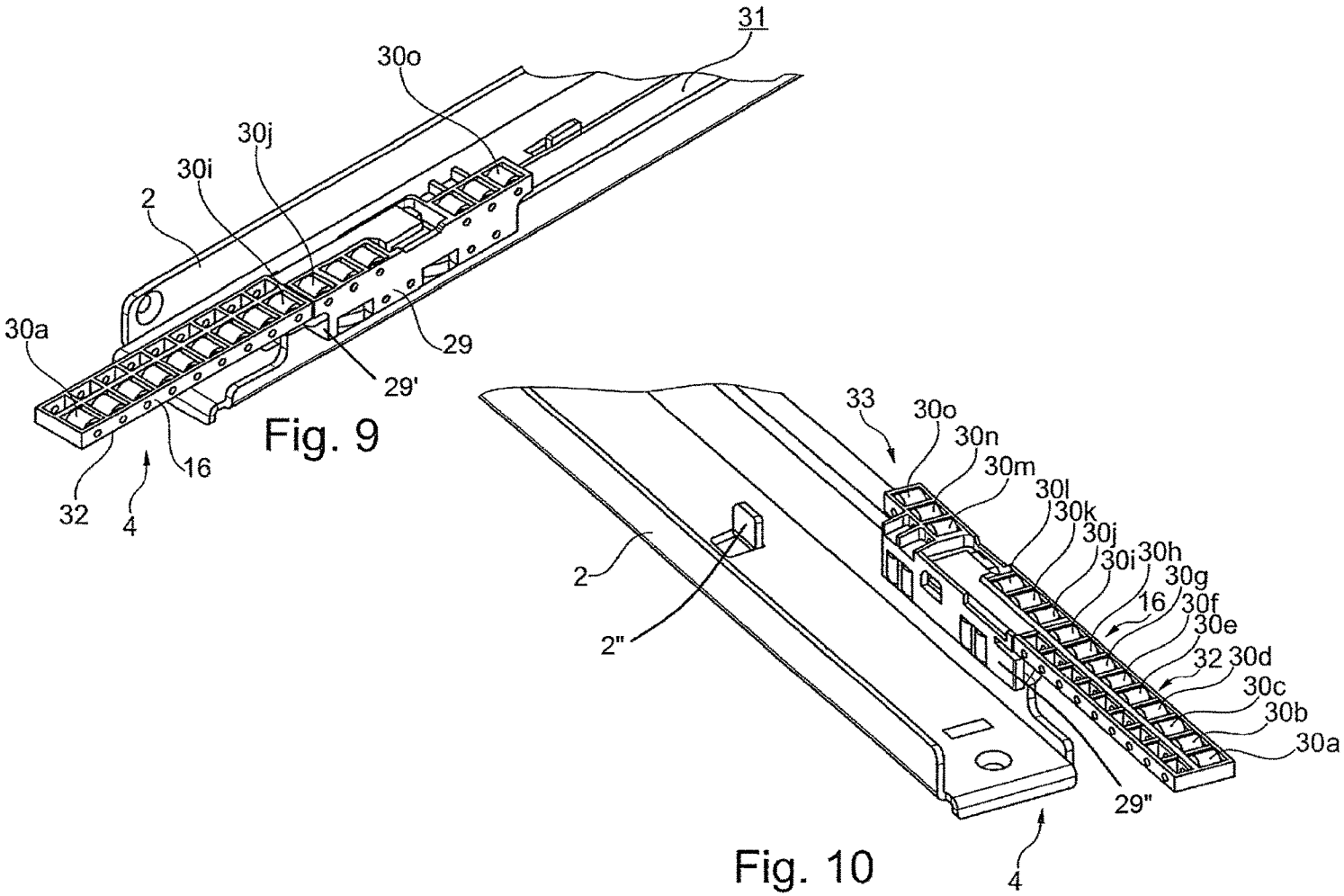
FIGS. 9 and 10 show perspective views from above, from laterally at the front, of a roller unit of a pull-out guide in the extended state at a front end of a cabinet rail.

FIGS. 9 and 10 show a roller unit 16, which is movably fitted by means of 15 rollers 30*a* to 30*o* on a upper guide surface 31 of the cabinet rail 2. In addition, the roller unit 16 comprises a carriage 29, which laterally embraces the cabinet rail 2 and by which the roller unit 16 is laterally guided and stabilized on the cabinet rail 2.

The rollers 30*a* to 30*i* are mounted in a projecting supporting portion 32 of the roller unit 16, which extends in a cantilever-like manner beyond that part of the cabinet rail 2 which is embraced by the carriage 29 of the roller unit 16. Depending on the length of the single extension pull-out guide 1, 26, 43, 46, the complete length of the roller unit 16, inclusive of the projecting supporting portion 32 with its rollers 30*a* to 30*i*, can be used to support the drawer rail 3 arranged thereon, when the rollers 30*j* to 30*o* roll on the upper guide surface 31. The roller unit 16 thus has the function of a middle rail having, in the present case, 15 rollers with comparatively large supporting length. As such, the cost of a separate middle rail can be eliminated.

If the drawer rail 3 is fully extended with a corresponding displacement of the roller unit 16 onto the frontal end 4 of the cabinet rail 2, the maximum extension position is then ended when a stop surface 29' of the carriage 29 of the roller unit 16 at the end of the cabinet rail 2 abuts the stop member 17*b* (see FIGS. 1 and 9). Due to the projecting supporting portion 32, the abutment does not take place at the rollers 30*a* to 30*i*, but only once the stop surface 29' of the carriage 29 engages the stop member 17*b*. The drawer rail 3 can hence be extended comparatively further in relation to the cabinet rail 2, because a comparatively large roller unit having more than 6 rollers, for example, 15 rollers, is available to provide support over a substantial region of the rail length during rolling on the upper guide surface 31.

Just before the stop surface 29' abuts the stop member 17*b*, however, a resilient portion 29" (see FIG. 10) of the carriage 29 (which is made of plastic, for example) engages protrusion 17*a*, which causes resilient portion 29" to deflect outwardly toward the opposite side of the cabinet rail 2. This interaction of 17*a* and 29" acts as a brake before stop surface 29' abuts stop member 17*b*.

Moreover, the projecting protective portion 32, in the region which overhangs in a cantilever-like manner, in the fully extended state according to FIGS. 9 and 10, can support the drawer rail 3 in a region where normally supporting of the above-situated rails does not take place, since the end of the underlying guiding upper guide surface 31, on which the rollers of the roller unit 16 roll, is reached.

As a result of this measure, a drawer rail 3 with drawer 52 arranged thereon is not only able to be extended further, but it is also possible, given at least the same extension pull-out guide length, to fit the single extension pull-out guide 1, 26, 43, 46, 49 on the drawer 52 in somewhat set back arrangement, so that a drawer front 51 or an appropriately encompassing frame does not need to be unlatched.

Figure 12A:
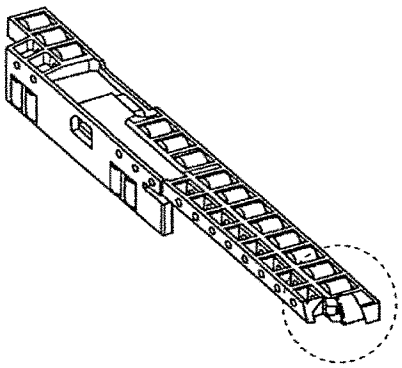
FIGS. 11*a*, 11*b* and 12*a*, 12*b* show perspective sectional views from above, from laterally at the front, through a roller unit, and roller arranged thereon, in two different variants, wherein FIGS. 11*b* and 12*b* respectively show the section through the roller unit in FIGS. 11*a* and 12*a* in enlarged representation.
Figure 12B:
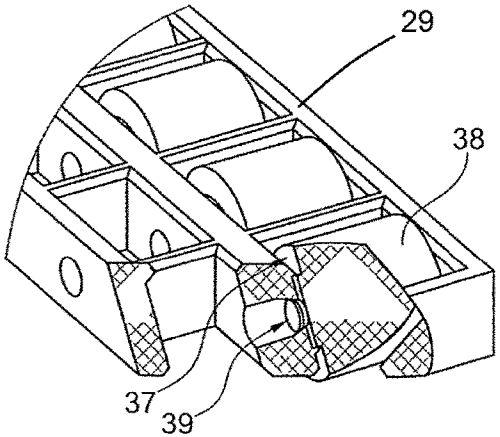
Figure 11A:
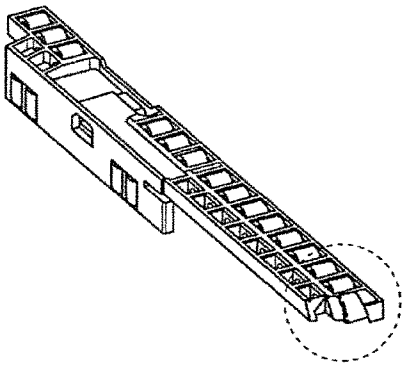
Figure 11B:
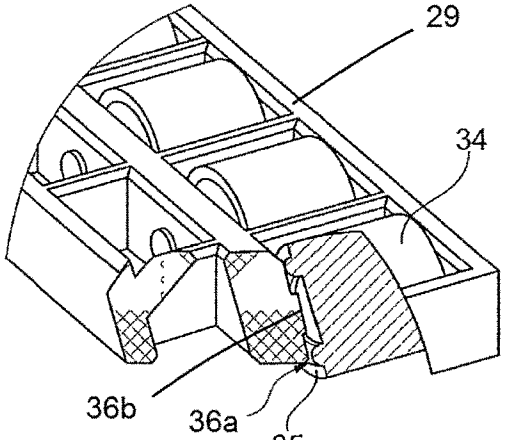

In FIGS. 11*a*, 11*b* and 12*a*, 12*b*, two different options for attaching rollers to the roller unit are shown. In FIG. 11*b* is represented a roller 34, which on one end face 35 has a toroidal, donut-like protruding bulge 36*a*, by means of which the roller 34 can be clicked onto mounting shafts 36*b* of the carriage 29 of the roller unit in a rotatable and positionally fixed manner. From a view perpendicular to an end face 35 of the roller 34, the toroidal bulge 36*a* is of annular design, having a ring center point which runs through a rotational axis of the roller 34. In FIG. 12*b*, on an end face 37 of a roller 38 is configured a pin-like bearing element 39, by means of which the roller 38 can be clipped onto the carriage 29 of the roller unit in a rotatable and positionally fixed manner.

Figure 13:
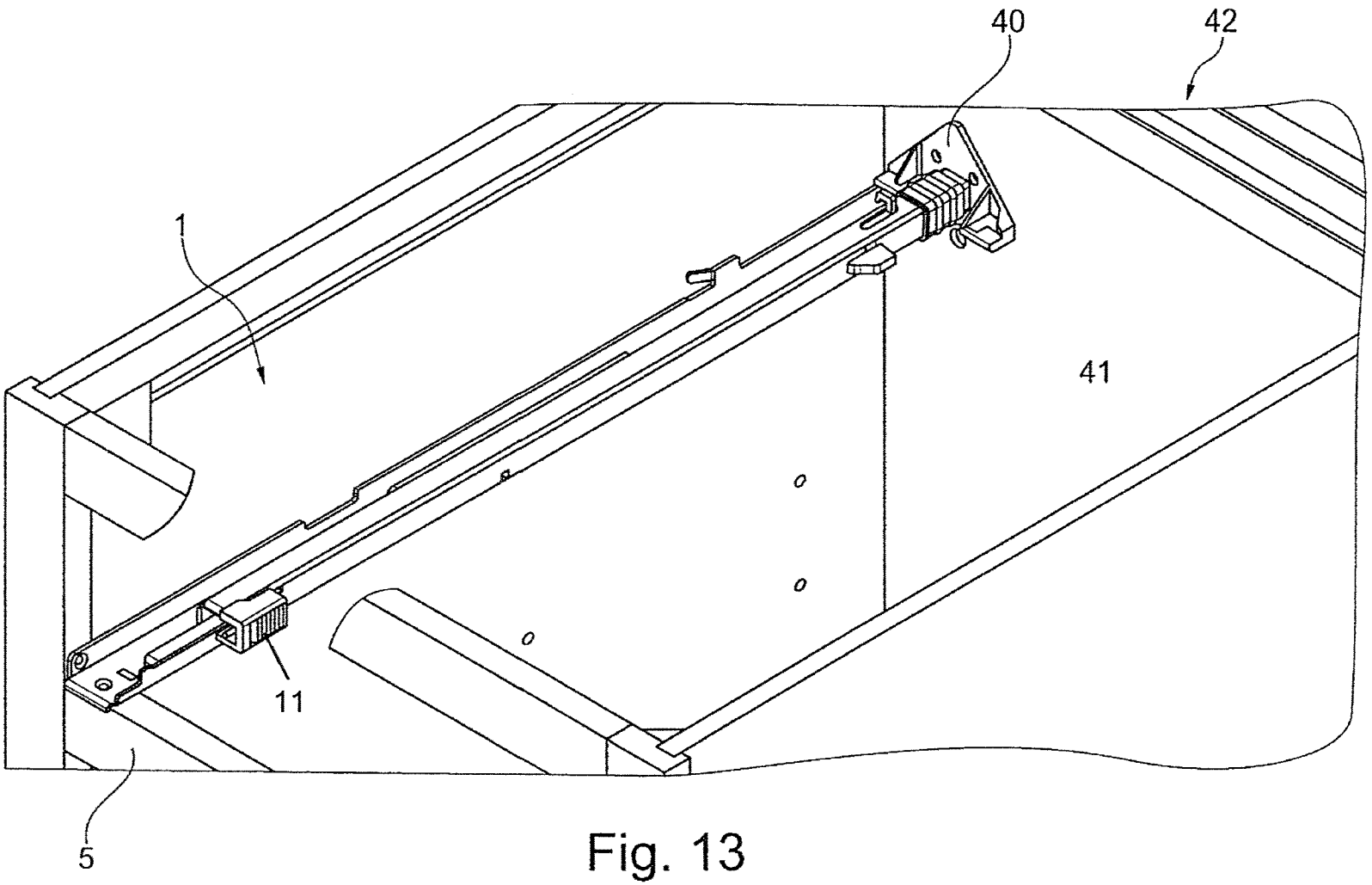
FIGS. 13 to 15 show perspective views from above, from laterally at the front, of fitting variants of pull-out guides according to the present invention on a furniture cabinet.
Figure 16A:
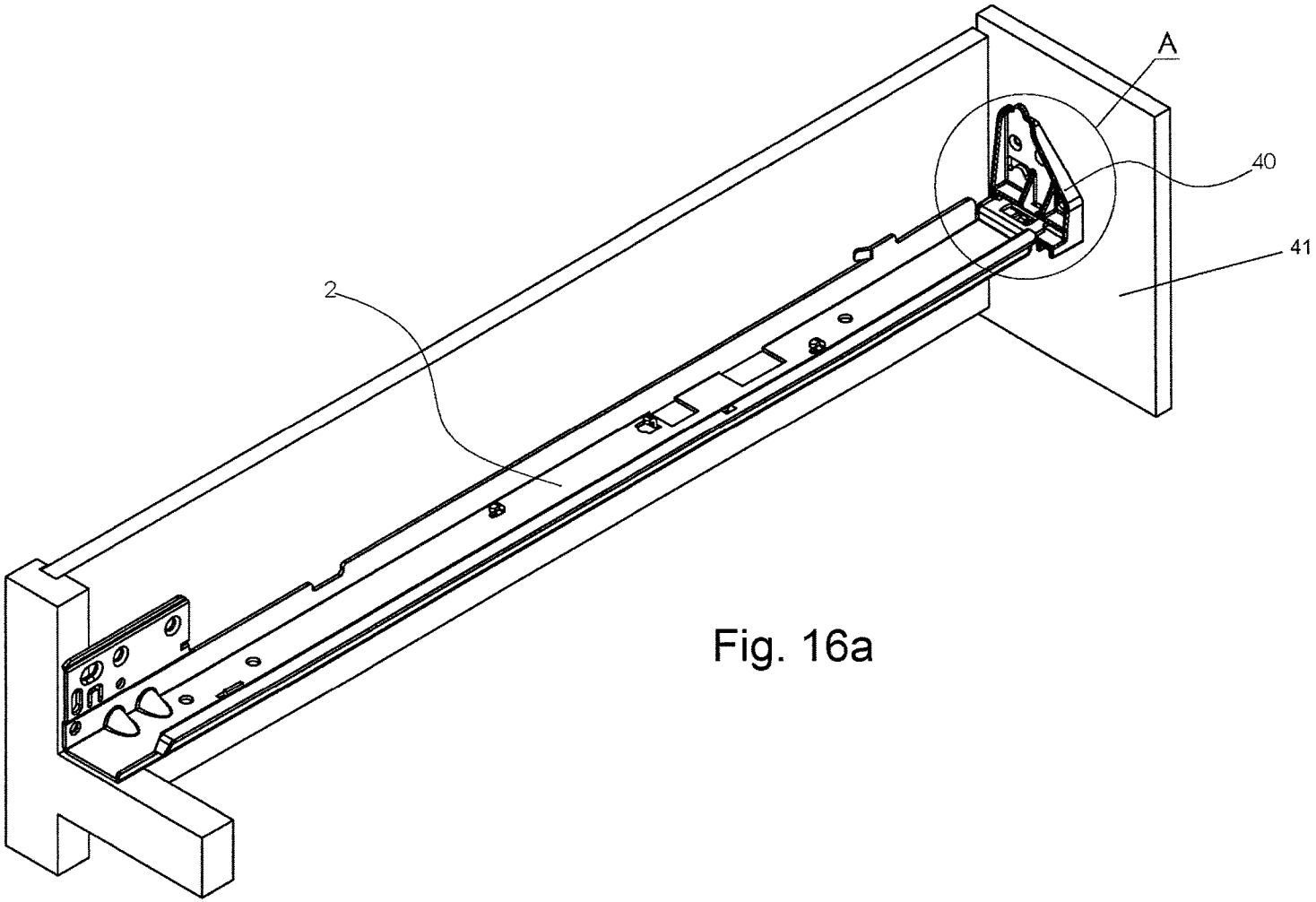
FIGS. 16*a*-16*d* show a further variant of a pull-out guide.
Figure 16B:
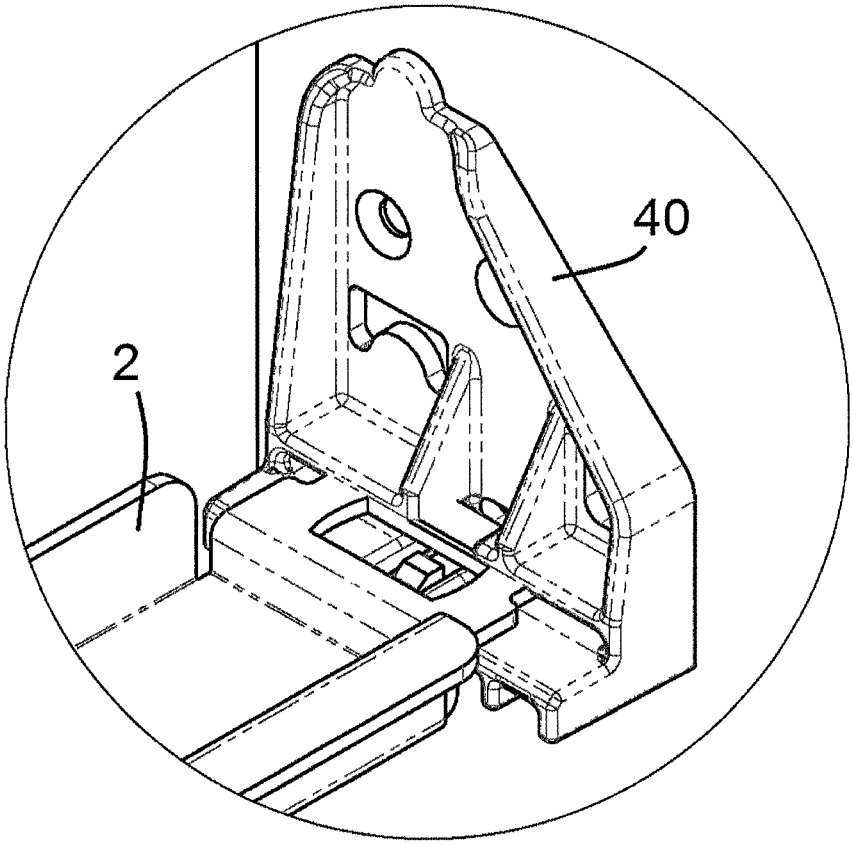
Figure 16C:
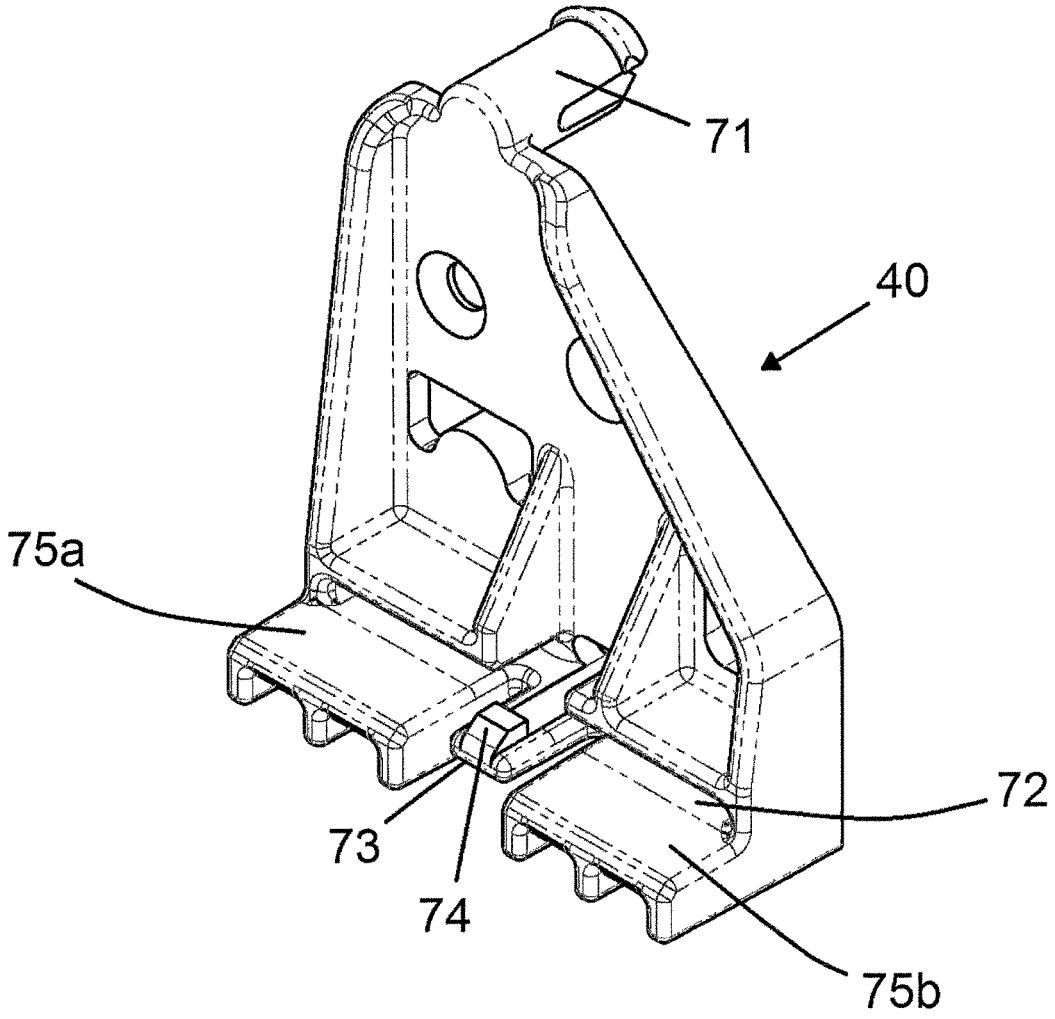
Figure 16D:
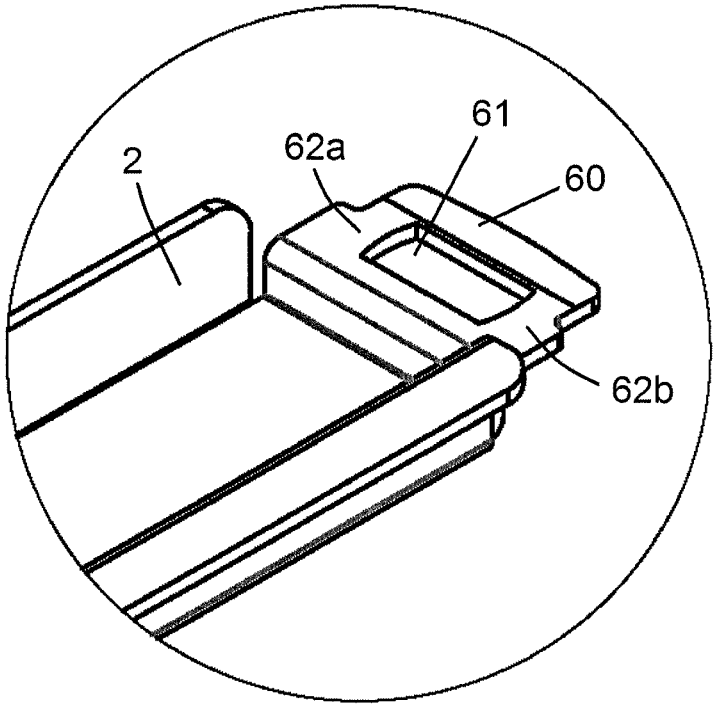

A further fastening variant of a single extension pull-out guide 1 is shown in FIG. 13. The single extension pull-out guide 1 is mounted at the frontal end on a cabinet crossbeam 5 and is fastened at the rear end, by means of a mounting member 40 formed of plastic or metal, to the rear wall 41 of a furniture cabinet 42. The mounting member 40 is here designed such that the single extension pull-out guide 1, at the rear region, can be laterally shifted or adjusted as explained below in more detail with respect to FIGS. 16*a*-16*c*.

Figure 14:
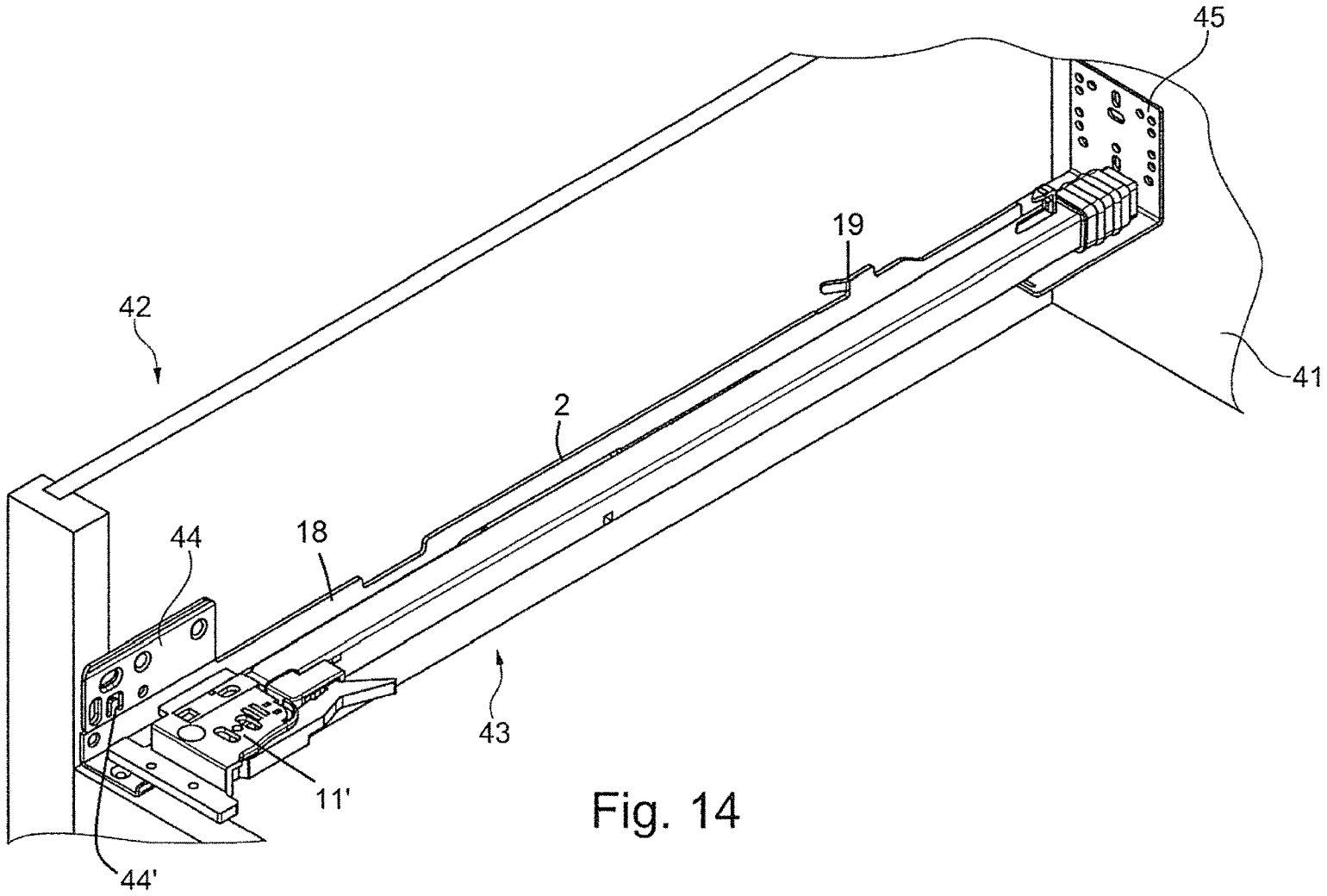
Figure 15:
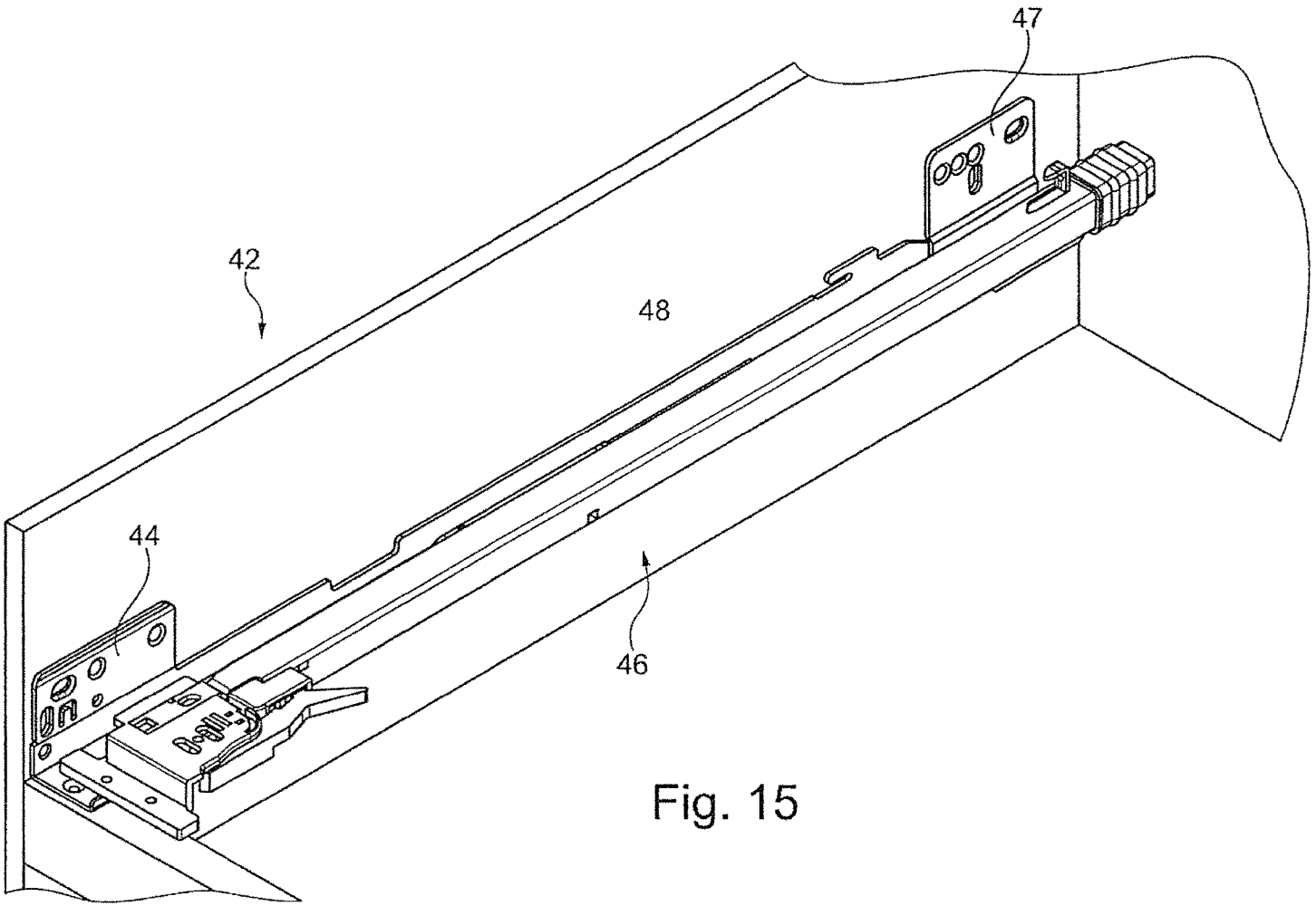

In FIGS. 14 and 15, further fitting variants of a single extension pull-out guide 43, 46 according to the present invention are shown. The single extension pull-out guides 43, 46 are fastened by means of mounting members 44, 45, 47, designed as metal brackets, to the front and rear end of the furniture cabinet 42. At the rear end of the furniture cabinet 42, the single extension pull-out guide 43 is fastened by the mounting member 45 to the rear wall 41. The single extension pull-out guide 46 is fitted, via the mounting member 47 at the rear end, on a side wall 48 of the furniture item 42.

FIG. 14 also shows a front locking device 11' that is secured to a drawer, and which locks into latching block 11 fixed to the drawer rail 3 (see FIG. 13).

FIG. 14 also shows a tab member 44' that extends outwardly from the mounting member 44 to assist an installer in aligning the mounting member correctly against the cabinet frame.

FIG. 14 also shows metal mounting member 45, which has an upwardly extending locking component that slides into the slot 12' on the rear end 12 of the cabinet rail 2 (FIG. 8).

By forming the cabinet rail 2 with only a single mounting member 44 at the front end thereof, a substantial cost-savings is realized, because two cabinet rails can be stamped out of a single piece of sheet metal having a size that was normally required to stamp out a single cabinet rail. The presence of the low-profile side element 18 accounts for at least 75% of the total length of the cabinet rail. The absence of metal of any appreciable height along the length of the cabinet rail 2 necessitated the addition of protruding element 19 to guide the side wall of the drawer 52 to ensure that, when the drawer 52 is assembled to the drawer rail 3, the holes (not shown) in the rear wall of the drawer 52 align with the hooks 10 on each drawer rail 3.

The forward mounting member 44 extends vertically upwardly to an extent higher than that of the protruding element 19, and extends longitudinally less than 25% of the total length of the cabinet rail 2.

FIGS. 16*a*-16*d* show another embodiment of a cabinet rail 2 and mounting member 40 connected to the rear wall 41 of the furniture cabinet. The rear end of the cabinet rail 2 includes a connection flange member 60 having a laterally extending slot 61 located between two support surfaces 62*a*, 62*b*. The mounting member 40, preferably made of injection-molded plastic, includes fastening members 71 (only one shown in FIG. 16*c*) that are inserted into corresponding holes formed in the inside rear wall 41 of the furniture cabinet. The mounting member 40 includes upper support surfaces 75*a*, 75*b* that align with the support surfaces 62*a*, 62*b* of flange member 60.

The mounting member 40 also includes an elongated recess 72, which extends into the mounting member 40 over the majority of the width of the mounting member 40, for receiving the tip end of the flange member 60. When the tip end of the flange member 60 is inserted into recess 72, a flexible latch mechanism 73 bends down and then up again, and retention member 74 locks in slot 61 of flange member 60 to lock the cabinet rail 2 in the mounting member 40. If necessary, flange member 60 can be unlocked from mounting member 40 by pushing down on retention member 74 and sliding the cabinet rail back away from elongated recess 72.

The width of flange member 60 is less than the width of elongated recess 42, and the width of retention member 44 is less than the width of slot 61. This arrangement allows for the rear end of cabinet rail 2 to move laterally and essentially self-adjust its position relative to the other cabinet rail as the drawer is being installed on the drawer rails, as well as during subsequent open/close cycles. This self-adjustment feature is very advantageous to make up for tolerances in the cabinet and drawer dimensions, as well as the accuracy by which the mounting members 40 are fixed to rear wall 41.

In the embodiment shown in FIGS. 16*a*-16*d*, the length of the steel cabinet rail 2 extends almost to the very rear wall 41 of the cabinet, which allows the length of the plastic mounting member 40 to be as short as possible. Maximizing the length of the steel cabinet rail 2 and minimizing the length of the mounting member 40 reduces the twist or binding of the overall pull-out guide when there is weight in the drawer.

In addition, in some instances the rigidity of the rear wall 41 of the furniture cabinet is sufficient that the slot 61 can be omitted from chair rail 2, and the flexible latch mechanism 73 and retention member 74 can also be omitted from the mounting member 40. Simply by fastening the cabinet rail 2 to the front end of the furniture cabinet is sufficient to prevent the cabinet rail 2 from becoming dislodged from the elongated recess 72 in the mounting member 40.

Figure 18A:
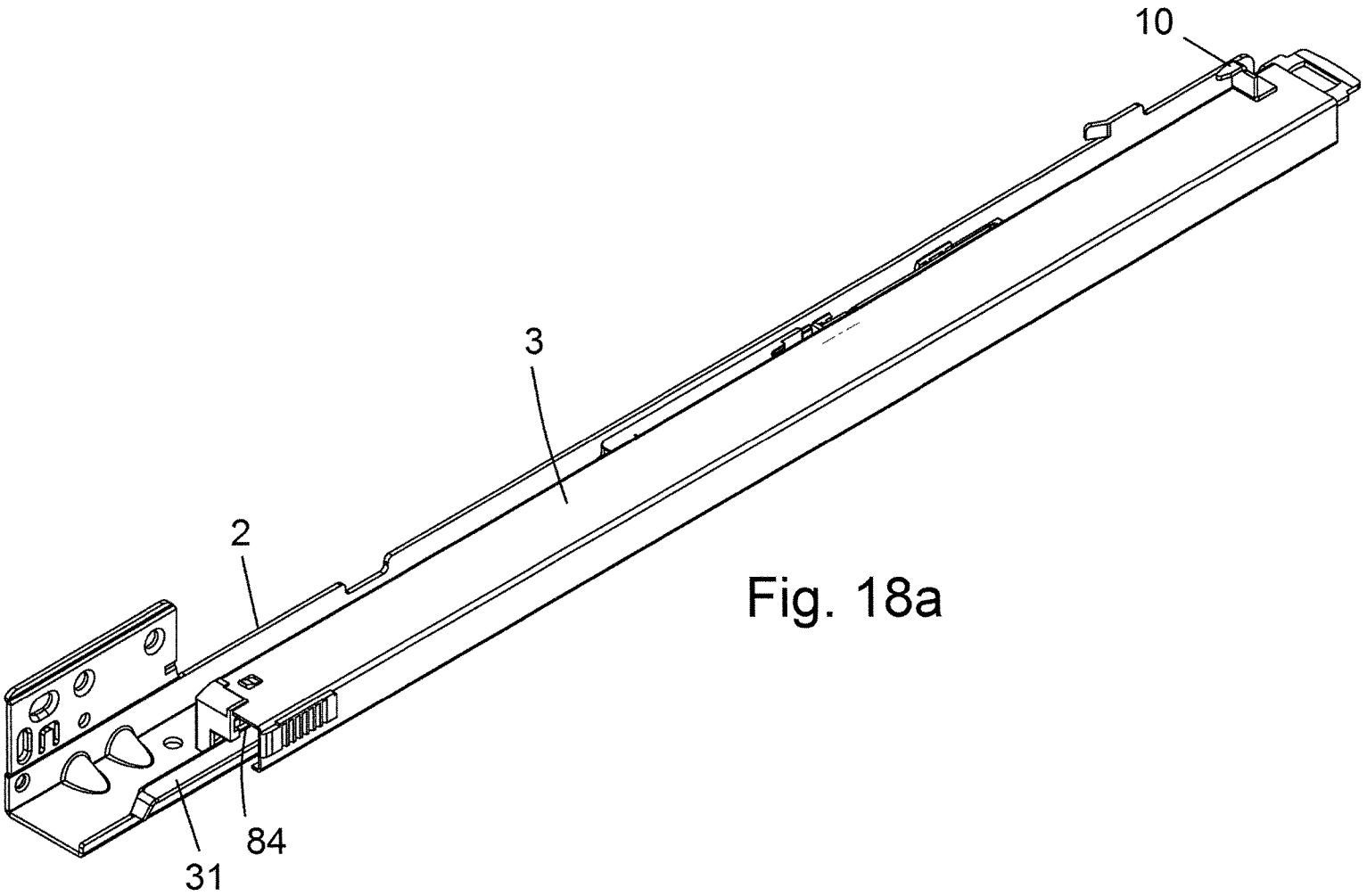
FIGS. 18*a*-18*c* show an exploded perspective view of a pull-out guide according to the present invention, which includes a middle rail and a second roller unit.
Figure 18B:
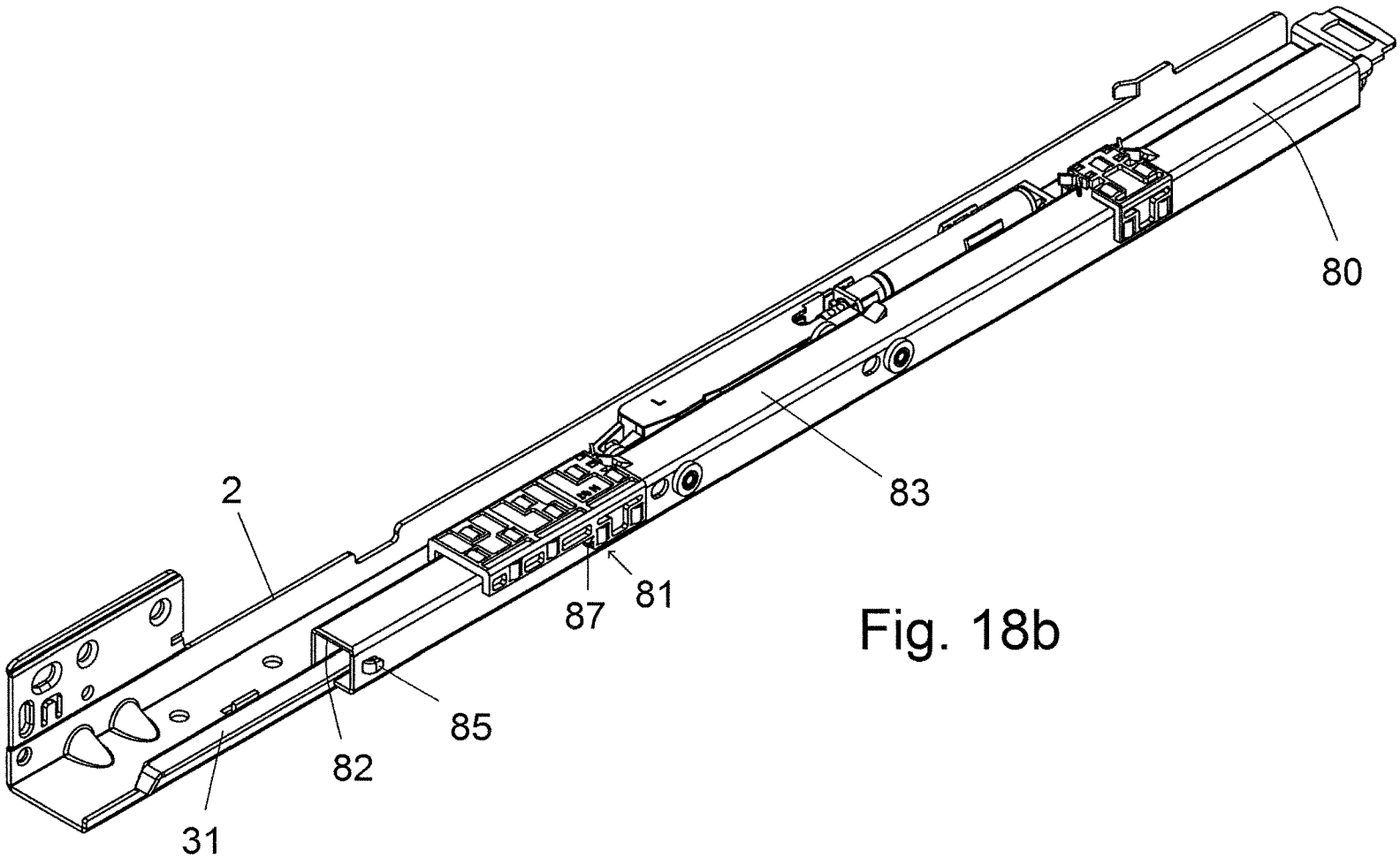
Figure 18C:
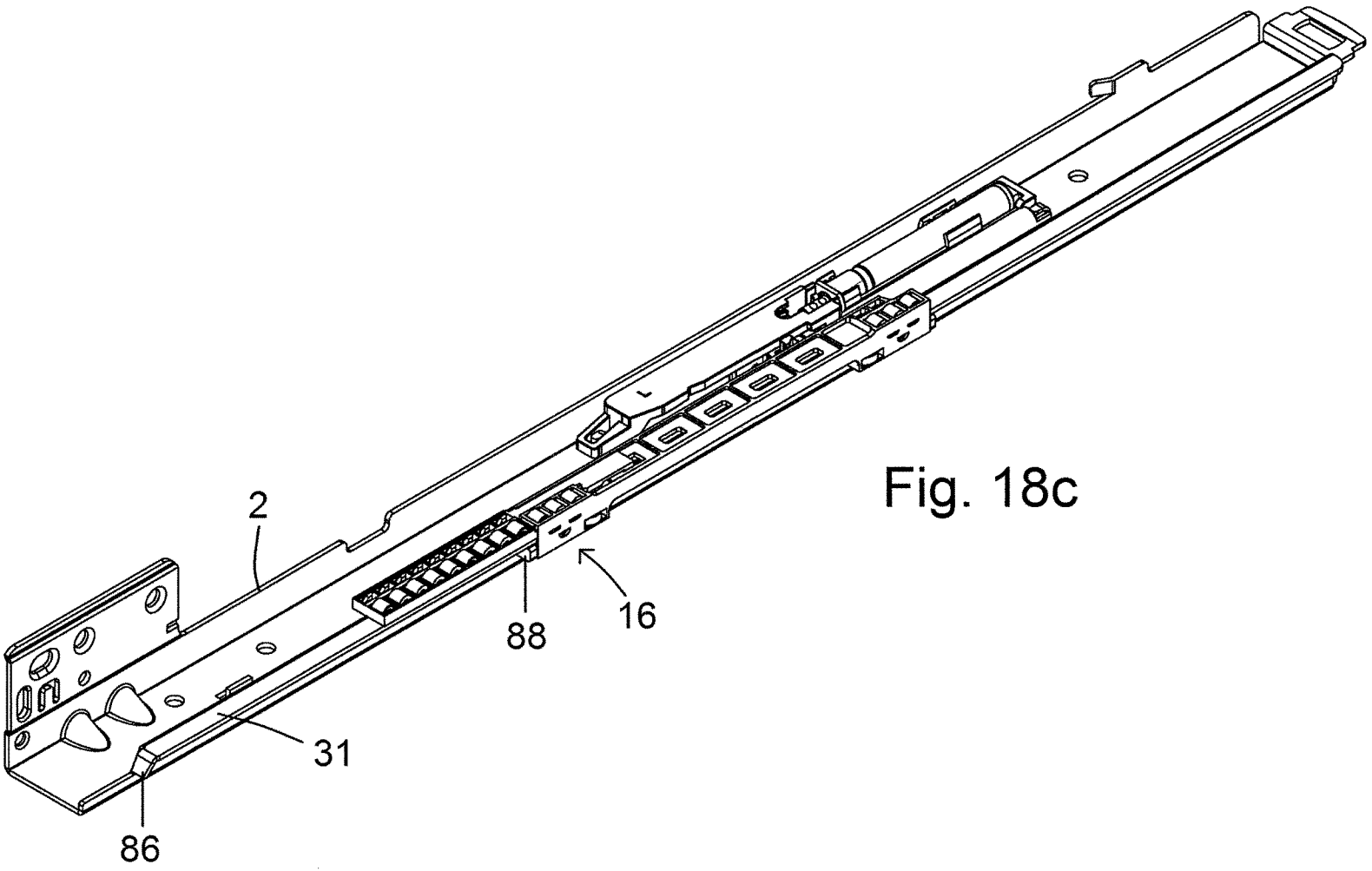

FIGS. 18*a*-18*c* show an exploded perspective view of a pull-out guide according to the present invention, which includes a middle rail 80 and a second roller unit 81. The middle rail 80 is positioned between the cabinet rail 2 and drawer rail 3. The rollers of the first roller unit 16 roll on respective upper and lower guide surfaces (31, 82) of the cabinet rail 2 and middle rail 80, and the rollers of the second roller unit 81 roll on respective upper and lower guide surfaces (83, 84) of the middle rail 80 and drawer rail 3.

Although not shown in the drawings, the rear portion of the drawer rail 3 includes a stop member that prevents the drawer rail 3 from extending beyond the carriage of the second roller unit 81. Similarly, and also not shown in the drawings, the rear portion of the middle rail 80 also includes a stop member that prevents the middle rail 80 from extending beyond the carriage of the first roller unit 16.

As shown in FIG. 18*b*, the middle rail 80 has a stop member 85 that prevents the carriage of the second roller unit 81 from extending beyond the front end of the middle rail 80, other than the cantilever-extension as described above with reference to FIGS. 9 and 10.

As shown in FIG. 18*c*, the cabinet rail 2 also includes a stop member 86 on the front end of the upper guide surface 31 that prevents the first roller unit 16 from extending beyond the front end of the cabinet rail beyond the extent shown in FIGS. 9 and 10.

There is also a stop surface 87 on the carriage of the second roller unit 81 that engages the stop member 85, and a stop surface 88 on the carriage of first roller unit 16 that engages stop member 86.

REFERENCE SYMBOL LIST

1 single extension pull-out guide
2 cabinet rail
2' support element
2" stop surface
3 drawer rail
3' upper support surface
3" stop member
3*a*, 3*b* first and second sides
3*c*, 3*d* top and bottom sides
4 end
5 cabinet crossbeam
6 tongue
7 fastening element
8 bore
8*a*, 8*b*, 8*c* bore
9 bore
10 hook
10*a*, 10*b* hook
11 latching block
11' front locking device
12 rear end
12' slot
13 mounting slot
14 automatic retraction mechanism
15 reinforcing clamp
16 roller unit
17*a* protrusion
17*b* stop member
18 low-profile side element
19, 19*a* element
20 latching member
21 bead
22 mounting opening
23 damper
24 region
25 top side
26 single extension pull-out guide
27*a*, 27*b* mounting bracket
28 end
29 carriage
29' stop surface

29" resilient portion
30*a*-30*o* rollers
31 upper guide surface
32 supporting portion
33 end
34 roller
35 end face
36*a* bulge
36*b* mounting shaft
37 end face
38 roller
39 bearing element
40 mounting member
41 rear wall
42 furniture cabinet
43 single extension pull-out guide
44 mounting member
44' tab member
45 mounting member
46 single extension pull-out guide
47 mounting member
48 side wall
49 full extension pull-out guide
50 drawer bottom
51 drawer front
52 drawer
53 boss
54 face
55 recess
60 flange member
61 slot
62*a*, 62*b* lower support surfaces
71 fastening member
72 elongated recess
73 flexible latch mechanism
74 retention member
75*a*, 75*b* upper support surfaces
80 middle rail
81 second roller unit
82 lower guide surface of 80
83 upper guide surface of 80
84 lower guide surface of 3
85 stop member for 80
86 stop member for 16
87 stop surface on 81
88 stop surface on 16

The invention claimed is:

1. A pull-out guide for the guidance of a drawer, comprising a cabinet rail for attachment to a furniture cabinet, a drawer rail for attachment to a drawer, and a roller unit having rollers that roll on guide surfaces of the respective rails during movement of the rails relative to one another, wherein the cabinet rail, which has a length, comprises a vertically oriented low-profile side element, the drawer rail comprises a support surface for the fitting of a drawer on the pull-out guide, the low-profile side element of the cabinet rail does not extend above the support surface of the drawer rail over at least 75% of the total length of the cabinet rail, and the low-profile side element comprises a protruding element that extends upwardly in the vertical direction from a region of the cabinet rail that defines a rearward one-third portion of the overall length of the cabinet rail, wherein the protruding element extends both longitudinally along the low-profile side element and vertically upward to a height that is above the support surface of the drawer rail, such that the protruding element has a flag-like shape, and wherein a remaining height of the low-profile side element is below the support surface of the drawer rail.

2. A drawer having a pull-out guide according to claim 1.

3. A furniture item having a drawer according to claim 1.

4. The pull-out guide according to claim 1, wherein the protruding element comprises a guide member that extends longitudinally toward a front end of the cabinet rail and is bent outwardly away from the cabinet rail at an acute angle.

5. The pull-out guide according to claim 4, wherein the cabinet rail further comprises a mounting member on a front end thereof, the mounting member extending vertically upwardly to an extent higher than that of the protruding element and extending longitudinally less than 25% of the total length of the cabinet rail.

6. The pull-out guide according to claim 1, wherein the low-profile side element includes a recess between the protruding element and a front end of the drawer rail, wherein the size of the recess corresponds to a size of the protruding element.

7. The pull-out guide according to claim 1, wherein the cabinet rail further comprises a support element extending perpendicularly to the low-profile side element, a first fastening member located on the low-profile side element, and a second fastening member located on the support element, whereby the cabinet rail can be fastened to a front region of the furniture cabinet by the first and second fastening members.

8. The pull-out guide according to claim 1, wherein the cabinet rail further comprises a downwardly extending tongue at a front end thereof and a fastening element on a bottom side of the cabinet rail spaced a distance rearwardly from the tongue, whereby the cabinet rail can be positioned on a frontal, horizontally running strut of the furniture cabinet by way of the tongue and fastening element.

9. The pull-out guide according to claim 8, wherein the distance is selected to correspond to a thickness of the strut.

10. The pull-out guide according to claim 1, wherein the drawer rail is a partial polygon in cross-section that includes four sides, and the pull-out guide further comprises a reinforcing clamp on a rear end region of the drawer rail, wherein the reinforcing clamp encloses at least part of at least three sides of the drawer rail.

11. The pull-out guide according to claim 10, wherein the reinforcing clamp encloses at least part of all four sides of the drawer rail.

12. The pull-out guide according to claim 10, wherein the reinforcing clamp is made of metal.

13. The pull-out guide according to claim 10, wherein the reinforcing clamp is fixed to the drawer rail without the use of tools.

14. The pull-out guide according to claim 13, wherein the reinforcing clamp is snapped onto the drawer rail by a latching member.

15. The pull-out guide according to claim 1, wherein the roller unit comprises cylindrical rollers, each of which has, on opposite flat end faces, toroidal, protruding bearing elements.

16. The pull-out guide according to claim 1, wherein the support surface of the drawer rail further comprises a suspension element for mating with a hole in a rear wall of the drawer.

17. The pull-out guide according to claim 16, wherein the suspension element comprises a bead.

18. The pull-out guide according to claim 16, wherein the suspension element comprises a damping element.

19. The pull-out guide according to claim 1, wherein the protruding element is formed as one piece with the cabinet rail.

20. The pull-out guide according to claim 1, wherein the protruding element is configured as a tab, which is a separate piece, that is snapped onto or plugged into the low-profile side element.

21. The pull-out guide according to claim 1, further comprising a middle rail between the cabinet rail and the drawer rail, and further comprising a second roller unit, wherein the rollers of each roller unit roll on guide surfaces of the respective rails during movement of the rails relative to one another.

22. A pull-out guide for the guidance of a drawer, comprising a cabinet rail for attachment to a furniture cabinet, a drawer rail for attachment to a drawer, and a roller unit having rollers that roll on guide surfaces of the respective rails during movement of the rails relative to one another, wherein the cabinet rail, which has a length, comprises a vertically oriented low-profile side element, the drawer rail comprises a support surface for fitting of a drawer on the pull-out guide and the drawer rail is a partial polygon in cross-section that includes four sides, and the pull-out guide further comprises a reinforcing clamp on a rear end region of the drawer rail, the reinforcing clamp encloses at least part of at least three sides of the drawer rail, the low-profile side element of the cabinet rail does not extend above the support surface of the drawer rail over at least 75% of the total length of the cabinet rail, and the low-profile side element comprises a protruding element that extends upwardly in the vertical direction from a region of the cabinet rail that defines a rearward one-third portion of the overall length of the cabinet rail, wherein the protruding element extends both longitudinally along the low-profile side element and vertically upward to a height that is above the support surface of the drawer rail, such that the protruding element has a flag-like shape, and wherein a remaining height of the low-profile side element is below the support surface of the drawer rail.

23. The pull-out guide according to claim 22, wherein the reinforcing clamp encloses at least part of all four sides of the drawer rail.

24. The pull-out guide according to claim 22, wherein the reinforcing clamp is made of steel.

25. The pull-out guide according to claim 22, wherein the reinforcing clamp is made of heat-treated steel.

26. The pull-out guide according to claim 22, further comprising a middle rail between the cabinet rail and the drawer rail, and further comprising a second roller unit, wherein the rollers of each roller unit roll on guide surfaces of the respective rails during movement of the rails relative to one another.

27. A pull-out guide for the guidance of a drawer, comprising a cabinet rail for attachment to a furniture cabinet, a drawer rail for attachment to a drawer, a roller unit having rollers that roll on guide surfaces of the respective rails during movement of the rails relative to one another, and a mounting member adapted to be fixed to an inner rear wall of the furniture cabinet, wherein the cabinet rail, which has a length, comprises a vertically oriented low-profile side element, the drawer rail comprises a support surface for the fitting of a drawer on the pull-out guide, the low-profile side element of the cabinet rail does not extend above the support surface of the drawer rail over at least 75% of the total length of the cabinet rail, the low-profile side element comprises a protruding element that extends upwardly in the vertical direction from a region of the cabinet rail that defines a rearward one-third portion of the overall length of the cabinet rail, wherein the protruding element extends both longitudinally along the low-profile side element and vertically upward to a height that is above the support surface of the drawer rail, such that the protruding element has a flag-like shape, and wherein a remaining height of the low-profile side element is below the support surface of the drawer rail, a rear end of the cabinet rail has a horizontally extending flange member, the mounting member has a horizontally extending elongated recess for receiving the flange member of the cabinet rail, and a lateral width of the flange member is less than a lateral width of the elongated recess to allow lateral movement of the flange member within the elongated recess.

28. The pull-out guide according to claim 27, wherein the flange member comprises a slot, and the mounting member includes a retention member that engages the slot to lock the cabinet rail to the mounting member.

29. The pull-out guide according to claim 28, wherein a lateral width of the retention member is less than a lateral width of the slot.

30. The pull-out guide according to claim 27, further comprising a middle rail between the cabinet rail and the drawer rail, and further comprising a second roller unit, wherein the rollers of each roller unit roll on guide surfaces of the respective rails during movement of the rails relative to one another.

31. A pull-out guide for the guidance of a drawer, comprising a cabinet rail for attachment to a furniture cabinet, a drawer rail for attachment to a drawer, and a roller unit having rollers that roll on guide surfaces of the respective rails during movement of the rails relative to one another, wherein the cabinet rail, which has a length, comprises a vertically oriented low-profile side element, the drawer rail comprises a support surface for the fitting of a drawer on the pull-out guide and a suspension element for mating with a hole in a rear wall of the drawer, the suspension element includes a damping member to accommodate for variations in the size of the hole in the drawer and for variations in an overall length of the drawer, the low-profile side element of the cabinet rail does not extend above the support surface of the drawer rail over at least 75% of the total length of the cabinet rail, and the low-profile side element comprises a protruding element that extends upwardly in the vertical direction from a region of the cabinet rail that defines a rearward one-third portion of the overall length of the cabinet rail, wherein the protruding element extends both longitudinally along the low-profile side element and vertically upward to a height that is above the support surface of the drawer rail, such that the protruding element has a flag-like shape, and wherein a remaining height of the low-profile side element is below the support surface of the drawer rail.

32. The pull-out guide according to claim 31, wherein the suspension member is welded to the support surface of the drawer rail.

33. The pull-out guide according to claim 31, wherein the suspension element has a bead.

34. The pull-out guide according to claim 31, further comprising a middle rail between the cabinet rail and the drawer rail, and further comprising a second roller unit, wherein the rollers of each roller unit roll on guide surfaces of the respective rails during movement of the rails relative to one another.

* * * * *